United States Patent [19]

Mihayashi et al.

[11] Patent Number: 4,746,601

[45] Date of Patent: May 24, 1988

[54] SILVER HALIDE PHOTOGRAPHIC LIGHT-SENSITIVE MATERIAL

[75] Inventors: Keiji Mihayashi; Hidetoshi Kobayashi; Shunji Takada, all of Kanagawa, Japan

[73] Assignee: Fuji Photo Film Co., Ltd., Kanagawa, Japan

[21] Appl. No.: 22,479

[22] Filed: Mar. 9, 1987

Related U.S. Application Data

[63] Continuation of Ser. No. 681,753, Dec. 14, 1984, abandoned.

[30] Foreign Application Priority Data

Dec. 15, 1983 [JP] Japan ..... 58-237106

[51] Int. Cl.[4] ..... G03C 1/08; G03C 1/485

[52] U.S. Cl. ..... 430/543; 430/567; 430/598; 430/547; 430/955; 430/599; 430/600

[58] Field of Search ..... 430/543, 547, 567, 598, 430/550, 566, 955, 957, 542, 599, 600

[56] References Cited

U.S. PATENT DOCUMENTS 4,199,355 4/1980 Hinshaw et al. ..... 430/955
4,390,618 6/1983 Kobayashi et al. ..... 430/955
4,482,629 11/1984 Nakagawa et al. ..... 430/955
4,500,633 2/1985 Menjo et al. ..... 430/506
4,518,682 5/1985 Kobayashi et al. ..... 430/955
4,522,917 6/1985 Ichijima et al. ..... 430/955

*Primary Examiner*—Won H. Louie
*Attorney, Agent, or Firm*—Sughrue, Mion, Zinn, Macpeak, and Seas

[57] ABSTRACT

A silver halide photographic light-sensitive material comprising a support having provided thereon at least one photographic layer including at least one silver halide emulsion layer, wherein at least one silver halide emulsion layer contains silver halide grains whose average value of the diameter corresponding to the projected area of a group of silver halide grains that take 40% of the total projected area of whole silver halide grains present in said silver halide emulsion layer is at least 1.5 μm and at least one photographic layer contains at least one compound capable of imagewise releasing a fogging agent or a precursor thereof or a development accelerator or a precursor thereof corresponding to a quantity of developed silver upon development, is disclosed. This material is of very high sensitivity and, furthermore, has a high developing speed and has reduced for formation irrespective of its high sensitivity.

12 Claims, 1 Drawing Sheet

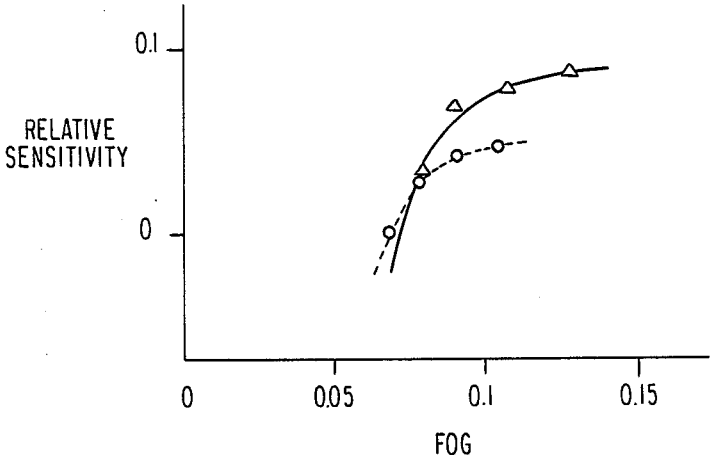
0.1
RELATIVE
SENSITIVITY
0
0
0.05
0.1
0.15
FOG

SILVER HALIDE PHOTOGRAPHIC LIGHT-SENSITIVE MATERIAL

This is a continuation of application Ser. No. 681,753, filed Dec. 14, 1984, abandoned.

FIELD OF THE INVENTION

The present invention relates to a silver halide photographic light-sensitive material. More specifically, it is concerned with a silver halide photographic light-sensitive material which is of high sensitivity and further has a high developing speed although it contains large-sized emulsion grains.

BACKGROUND OF THE INVENTION

Recently, in the field of silver halide photographic light-sensitive materials, in particular, used for photographing, those having high sensitivity as typically illustrated by ISO 1,000 films, etc. or those having high image quality and high resolving power suitable for use in small format cameras as typically illustrated by 110 sized cameras or disc cameras have been desired. This desire is growing not only in color light-sensitive materials but also in black-and-white light-sensitive materials, particularly for use in photographing.

For the purpose of increasing the sensitivity, investigations have been made on various techniques including, e.g., large-sized silver halide grains, couplers with high activities, accelerated development, etc. However, the increase in sensitivity based on large-sized silver halide grains seems to be reaching its limit, as reported by G. C. Farnell and J. B. Chanter in *Journal of Photographic Science,* Vol. 9, page 75 (1961). Accordingly, this technique is not expected to make much contribution in the future.

The present inventors have found that development using p-phenylenediamine-based color developing agents commonly employed is a so-called parallel-type development in which silver halide grains are developed gradually and simultaneously. Even in black-and-white development, when D-76 processing or a metol-/ascorbic acid type surface developer, for example, is employed, parallel-type development is observed. In parallel-type development, the tendency that the sensitivity reaches the upper-most limit becomes particularly marked in a large-sized region as compared with the granular-type development in which silver halide grains are developed at one time from the beginning (e.g., D-76 or HI-RENDOL or RD-III for X-ray development formulation by Fuji Photo Film Co., Ltd.). It has further been found that in parallel-type development the developing speed of each emulsion grains in cases of large-sized emulsions is seriously decreased even though a latent image is formed on the surface of the silver halide grains. As a result, the sensitivity is not increased but, rather, reduced and the graininess in highly exposed areas is decreased.

For the purpose of accelerating development to increase the sensitivity, the present inventors have made extensive investigations on the incorporation of various development accelerators such as hydrazine compounds in an emulsion layer or a developer. In all development accelerators, however, these are often an associated increase in fog and deterioration in graininess. This is, the acceleration of development of large-sized grains cannot be attained without causing other problems.

In addition, investigations have been made to increase the sensitivity by using conventional couplers of high sensitivity. In this case, however, an increase in fog and deterioration in graininess seriously occur. That is, the conventional couplers fail to satisfactorily increase the sensitivity.

SUMMARY OF THE INVENTION

An object of the invention is to provide a highly sensitive silver halide photographic light-sensitive material.

Another object of the invention is to provide a silver halide photographic light-sensitive material which has a fast developing speed irrespective of its high sensitivity and is reduced in fog formation.

Still another object of the invention is to provide a silver halide photographic light-sensitive material which is improved in graininess irrespective of its high sensitivity.

The above objects have been met by a silver halide photographic light-sensitive material comprising a support having provided thereon at least one photographic layer including at least one silver halide emulsion layer, wherein at least one silver halide emulsion layer contains silver halide grains whose average value of the diameter corresponding to the projected area of a group of silver halide grains that take 40% of the total projected area of whole silver halide grains present in said one silver halide emulsion layer is at least 1.5 microns, and the photographic layer contains at least one compound capable of imagewise releasing a fogging agent or a precursor thereof or a development accelerator or a precursor thereof corresponding to a quantity of developed silver upon development.

BRIEF DESCRIPTION OF THE DRAWING

The FIGURE shows the results of Example 2. The open circles represent the results of Samples 101 and 201 to 203 in which an FR compound was not used, and the triangles represent the results of Samples 101′ and 201′ to 203′ in which an FR compound was used. They are connected to each other with solid and dotted lines. The sensitivity is indicated as the logarithm of an exposure amount to provide an optical density of fog+0.3; 0.1, when calculated as a real number, is equivalent to 126%.

DETAILED DESCRIPTION OF THE INVENTION

In the present invention, the compound releasing a fogging agent, a development accelerator or precursors thereof (hereinafter referred to collectively as an "FA"), corresponding to a quantity of developed silver upon development, may be added to any photographic layers. The compound is hereinafter referred to as an "FR compound".

That is, the FR compound may be incorporated in a silver halide emulsion layer containing such silver halide grains whose average value of the diameter corresponding to the projected area of a group of silver halide grains that take 40% the total projected area of whole silver halide grains is at least 1.5 microns, or it may be incorporated in other photographic layers. The silver halide grains as defined above are hereinafter referred to as "gigantic silver halide grains", and a silver halide emulsion layer containing such gigantic silver halide grains is referred to hereinafter as an "HG emulsion layer". Preferably the FR compound is added to the HG emulsion layer or its adjacent layer. In the latter case, the adjacent layer may be a light-sensitive layer or a light-insensitive layer such as an interlayer As long as, upon to silver development, the FR compound releases an FA and the thus-released FA acts to accelerate the development of gigantic silver halide grains, the FR compound can be added to any desired photographic layer including the HG emulsion layer.

In a preferred embodiment of the present invention, the silver halide photographic light-sensitive material comprises a support having provided thereon at least one silver halide emulsion layer, wherein at least one silver halide emulsion layer contains both silver halide grains whose average value of the diameter corresponding to the projected area of a group of silver halide grains that take 40% of the total projected area of whole silver halide grains is at least 1.5 microns and at least one compound capable of imagewise releasing a fogging agent or a precursor thereof or a development accelerator or a precursor thereof corresponding to a quantity of developed silver upon development.

Although the action and mechanism of the present invention has not yet been made clear completely, it is believed as follows.

When the gigantic silver halide grains of the present invention are subjected to parallel-type development using a p-phenylenediamine-based color developing agent, for example, the FR compound releases an FA in the silver developed areas, and the thus-released FA acts on the gigantic silver halide grains, not developed or in an earlier stage of development, present in the neighborhood of the FR compound.

The FA increases the activity of the development active sites or the number of development starting sites through, e.g., injection of electrons or formation of silver sulfide.

Since the FA is imagewise released upon silver development, high sensitivity and acceleration of development are attained without increasing fog, which could not be achieved using gigantic silver halide grains alone. Moreover, desirable effects such as improvement in graininess, increasing contrast, and an increase in color reproduction can be obtained by the action of the FA In some cases, the amount of silver to be coated can be reduced.

In the present invention, the use of the FR compound in combination with the HG emulsion enables an increase in the toe sensitivity without increasing fog. In other words, in high sensitivity areas, an HG emulsion system in which the FR compound is used in combination can provide the same toe sensitivity with less formation of fog than a large-sized emulsion system in which the FR compound is not used in combination, and can provide a higher toe sensitivity with the same fog. As described above, unexpectedly, an increase in the toe sensitivity/fog ratio can be attained along with the effects of, e.g., accleration of development and improvement in graininess.

FR compounds which can be used in the present invention include the following examples (i) to (iii). The symbol "FA" as used herein indicates a fogging agent, a development accelerator or precursors thereof.

(i) Couplers capable of releasing FA upon coupling with an oxidation product of an aromatic primary amine developing agent.

(ii) Couplers capable of forming a diffusible coupling product which functions as FA upon coupling with an oxidation product of an aromatic primary amine developing agent.

(iii) Redox compounds capable of releasing FA upon oxidation-reduction reaction with an oxidation product of an aromatic primary amine developing agent or the subsequent reaction.

These compounds (i), (ii) and (iii) can be represented by the following formulae (1), (2) and (3), respectively.

$$\text{Cp—(TIME)}_n\text{—FA} \quad (1)$$

$$\text{BALL—Cp—(TIME)}_n\text{—FA} \quad (2)$$

$$\text{RED—(TIME)}_n\text{—FA} \quad (3)$$

wherein Cp represents a coupler residue capable of coupling with an oxiation product of an aromatic primary amine developing agent; BALL represents a non-diffusible group which is eliminated from Cp upon the coupling reaction with an oxidation product of an aromatic primary amine developing agent; RED represents a residue of a compound capable of undergoing oxidation-reduction reaction with an oxidation product of an aromatic primary amine development agent; TIME represents a timing group releasable from Cp or RED upon coupling reaction or oxidation-reduction reaction to release FA; n represents 0 or 1; FA represents a group releasable from Cp or RED upon coupling when n is 0, or a group releasable from TIME when n is 1.

In the above-described formula (2), FA may not be released from Cp or TIME after the coupling reaction.

In the above-described formulae (1), (2) and (3), FA represents a so-called fogging agent which reacts with silver halide grains during development to form a fog nucleus capable of starting development. FA includes groups which reductively react with silver halide grains to form fog nuclei and groups which react with silver halide grains to form silver sulfide nuclei capable of starting development.

Preferred FA groups are those containing a group having an adsorbing property onto silver halide grains and can be represented by the formula:

$$\text{AD—(L)}_m\text{—X}$$

wherein AD represents a group adsorptive onto silver halide grains; L represents a divalent group; m represents 0 or 1; and X represents a reducing group or a group capable of reacting with silver halide to form silver sulfide; with proviso that when X is a group capable of reacting with silver halide to form silver sulfide and also has a function of AD, the group AD—$(L)_m$— is not necessarily required.

When FA is a group represented by AD—$(L)_m$—X, it may be bonded to TIME, Cp or RED at an optional position of AD—$(L)_m$—X.

In the formula (1), —$(TIME)_n$—FA is bonded to the coupling position of Cp, and the bond is cleaved upon coupling reaction.

In the formula (2), BALL is bonded to Cp at the coupling position thereof, and the bond is cleaved upon coupling reaction. Since —$(TIME)_n$—FA is bonded to Cp at the non-coupling position thereof, this bond is not cleaved directly by the coupling reaction.

In the formula (3), —$(TIME)_n$—FA is bonded to RED at such a position that —$(TIME)_n$—FA is released therefrom by the oxidation-reduction reaction with an oxidation product of an aromatic primary amine developing agent or the subsequent reaction.

The group represented by TIME may be trivalent group in the formula (1). Such being the case, one of the three bonds is bonded to FA and one of the remaining two bonds is bonded to the coupling position of Cp, with the other being bonded to the non-coupling position of Cp. When a compound having such a bond-structure is reacted with an oxidation product of an aromatic primary amine developing agent, the bond between TIME and the coupling position of Cp is cleaved, but the bond at the non-coupling position is not split off. The bond between TIME and FA is then cleaved through electron transfer reaction and/or intramolecular nucleophilic substitution of the anion, i.e., cleaved bond, of TIME whereby FA is released. Therefore, such a compound having a trivalent TIME should also have a structure capable of releasing FA by intramolecular electron transfer reaction and/or intramolecular nucleophilic substitution reaction.

The FR compounds represented by the aforesaid formulae (1), (2) and (3) will further be described in detail below.

In the formula (1), the coupler residue as represented by Cp has a partial structure of yellow, magenta and cyan couplers as well as colorless couplers and black-forming couplers.

Typical examples of the yellow couplers are described in U.S. Pat. Nos. 2,875,057, 2,407,210, 3,265,506, 2,298,443, 3,048,194 and 3,447,928, etc. Of these yellow couplers, acylacetamide derivatives, such as benzoylacetanilide, pivaloylacetanilide, etc., are preferred.

Accordingly, yellow coupler residues as Cp preferably include those represented by the formulae (I) and (II):

[I]

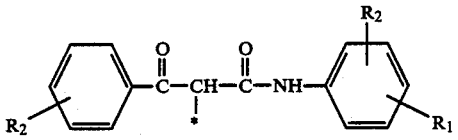

[II]

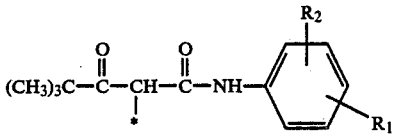

wherein the asterisk (*) indicates a position to which FA or TIME is bonded (hereinafter the same up to formula (XV)); $R_1$ represents a nondiffusible group having from 8 to 32 total carbon atoms; and $R_2$, which may be the same or different when $R_2$ represents 2 or more groups, represents a hydrogen atom or one or more of a halogen atom, a lower alkyl group, a lower alkoxy group and a nondiffusible group having from 8 to 32 total carbon atoms.

Typical examples of the magenta couplers are described in, e.g., U.S. Pat. Nos. 2,600,788, 2,369,489, 2,343,703, 2,311,082, 3,152,896, 3,519,429, 3,062,653 and 2,908,573, Japanese Patent Publication No. 27411/72 and Japanese Patent Application (OPI) Nos. 171956/84 and 162548/84, etc. Of these, pyrazolones and pyrazoloazoles (e.g., pyrazolopyrazole, pyrazoloimidazole, pyrazolobenzimidazole, pyrazolotriazole, pyrazolotetrazole, etc.) are preferred.

Accordingly, magenta coupler residues as Cp preferably include those represented by the formulae (III), (IV) and (V):

[III]

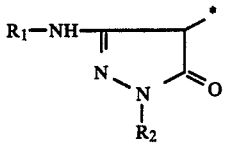

[IV]

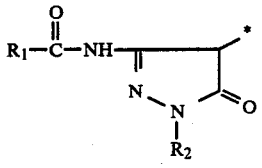

(V)

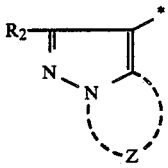

wherein $R_1$ represents a nondiffusible group having from 8 to 32 total carbon atoms; $R_2$ represents a halogen atom, a lower alkyl group, a lower alkoxy group, a phenyl group or a substituted phenyl group; and Z represents a non-metallic atomic group necessary to form a substituted or unsubstituted 5-membered azole ring containing from 2 to 4 nitrogen atoms (the substituent for the azole ring includes a condensed ring).

Typical examples of the cyan couplers are described in, e.g., U.S. Pat. Nos. 2,772,162, 2,895,826, 3,002,836, 3,034,892, 2,474,293, 2,423,730, 2,367,531 and 3,041,236, Japanese Patent Application (OPI) Nos. 99341/81, 155538/82, 204545/82, 189154/83, 31953/84, 118643/83, 187928/83 and 213748/83, and U.S. Pat. No. 4,333,999, etc. Of these, phenols and naphthols are preferred.

Accordingly, preferred cyan coupler residues as Cp include those having the following formulae (VI), (VII), (VIII) and (IX).

[VI]

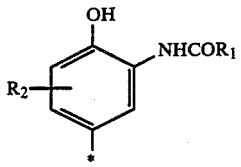

[VII]

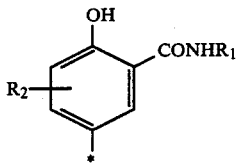

[VIII]

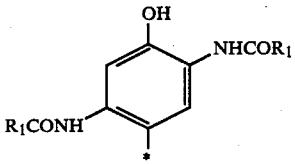

-continued

[IX]

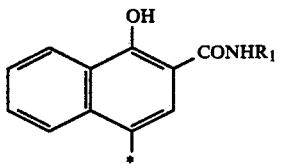

wherein $R_1$ represents a nondiffusible group of from 8 to 32 total carbon atoms; and $R_2$, which may be the same or different when $R_2$ represents two or more groups, represents one or more of a halogen atom, a lower alkyl group or a lower alkoxy group.

Specific examples of the colorless couplers are disclosed in, e.g., U.S. Pat. Nos. 3,912,513 and 4,204,867, and Japanese Patent Application (OPI) No. 152721/77, etc.

Typical examples of these colorless couplers have skeletons represented by the following formulae (X), (XI) and (XII).

(X)

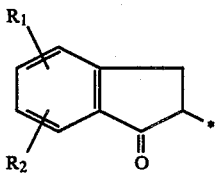

wherein $R_1$ represents a nondiffusible group of from 8 to 32 total carbon atoms; and $R_2$ represents a hydrogen atom, a halogen atom, a lower alkyl group or a lower alkoxy group.

(XI)

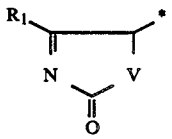

wherein $R_1$ represents a nondiffusible group of from 8 to 32 total carbon atoms; and V represents an oxygen atom, a sulfur atom or a nitrogen atom.

(XII)

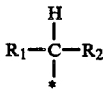

wherein $R_1$ and $R_2$ each represents an alkoxycarbonyl group, an aminocarbonyl group, an acyl group, a group derived from a sulfonic acid or sulfinic acid derivative corresponding to the above described groups, a cyano group, an ammoniumyl group, a nitrogen-containing heterocyclic group which is bonded at the N-position thereof, or a like group; $R_1$ and $R_2$ may be bonded together to form a 5- or 6-membered ring.

Cp further includes coupler residues of couplers which form a black color upon reacting with an oxidation product of a developing agent. Examples of such black color forming couplers are described in, e.g., U.S. Pat. Nos. 1,939,231, 2,181,944, 2,333,106 and 4,126,461, West German Patent Application (OLS) Nos. 2,644,194 and 2,650,764, etc.

More specifically, these black color forming couplers are represented by the following formulae (XIII), (XIV) and (XV).

(XIII)

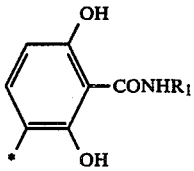

(XIV)

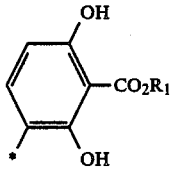

(XV)

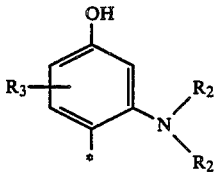

wherein $R_1$ represents an alkyl group of from 3 to 20 carbon atoms, a phenyl group, or a phenyl group substituted with a hydroxyl group, a halogen atom, an amino group or an alkyl or alkoxy group of from 1 to 20 carbon atoms; $R_2$'s, which may be the same or different, represent a hydrogen atom, a halogen atom, an alkyl or alkenyl group of from 1 to 20 carbon atoms or an aryl group of from 6 to 20 carbon atoms; and $R_3$, which may be the same or different when $R_3$ represents two or more groups, represents one or more of a halogen atom, an alkyl or alkoxy group of from 1 to 20 carbon atoms or any other monovalent organic group.

Cp as represented by the above described formulae (I) to (XV) may form a polymer including a dimer, a trimer, etc., at the moiety other than the coupling position, and may also be bonded to a polymer at the moiety other than the coupling position.

In the formula (2), the coupler residues as represented by Cp have partial structures represented by the aforesaid formulae (I) to (XV), wherein the asterisk (*) indicates a position to which BALL is bonded and —(-TIME)$_n$—FA is bonded to one of other positions.

In the formula (2), the nondiffusible group as represented by BALL has such a size and a form that impart nondiffusibility to couplers. The nondiffusible group may be a polymeric group comprising a plurality of releasable groups connected to each other, or may have a nondiffusibility-imparting alkyl and/or aryl group(s). In the latter case, the alkyl and/or aryl group(s) preferably contain(s) about 8 to 32 total carbon atoms. BALL has a group for bonding to the coupling position of Cp. Such a group for bonding typically includes —O—, —S—, —N=N—,

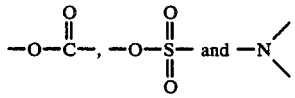

that constitutes a heterocyclic ring.

In the formula (3), the group represented by RED is a group having a skeleton of hydroquinone, catechol, o-aminophenol or p-aminophenol and capable of undergoing oxidation-reduction reaction with an oxidation product of an aromatic primary amine developing agent and subsequently alkali-hydrolysis to thereby release —(TIME)$_n$—FA. In the hereinafter given formulae (XVI) to (XXI), the group —(TIME)$_n$—FA is abbreviated as FR.

Specific examples of RED are represented by the following formulae (XVI) to (XXI).

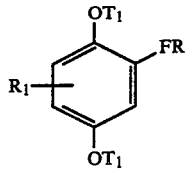

(XVI)

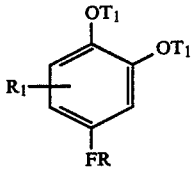

(XVII)

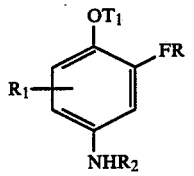

(XVIII)

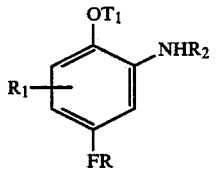

(XIX)

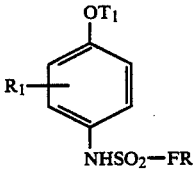

(XX)

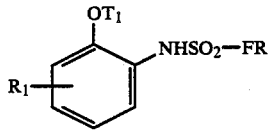

(XXI)

wherein $R_1$ represents a hydrogen atom, a halogen atom, an alkyl group, an aryl group, an alkoxy group, an aryloxy group, an alkylthio group, an arylthio group, a cyano group, an alkoxycarbonyl group, a carbamoyl group, a sulfamoyl group, a carboxyl group, a sulfo group, a sulfonyl group, an acyl group, a carbonamido group, a sulfonamido group or a heterocyclic group; when $R_1$ represents two or more groups, they may be the same or different, or two vicinal $R_1$ groups may be connected to form a benzene ring or a 5- to 7-membered hetero ring; $R_2$ represents an alkyl group, an aryl group, an acyl group, a carbamoyl group, a sulfonyl group or a sulfamoyl group; and $T_1$, which may be the same or different in the formulae (XVI) or (XVII), represents a hydrogen atom or a group releasable by hydrolysis under an alkaline condition.

Typical examples of $T_1$ include a hydrogen atom, an acyl group, a sulfonyl group, an alkoxycarbonyl group, a carbamoyl group, an oxalyl group, etc.

The timing group as represented by TIME can include a group which is releasable from Cp or RED by coupling reaction or oxidation-reduction reaction and then releases FA through intramolecular substitution as described in, e.g., U.S. Pat. No. 4,248,962 and Japanese Patent Application (OPI) No. 56837/82; a group which releases FA by electron transfer reaction via a conjugated system as described in, e.g., British Pat. No. 2,072,363 A and Japanese Patent Application (OPI) Nos. 154234/82, 188035/82, 114946/81, 56837/82, 209736/83, 209727/83, 209738/83, 209740/83 and 98728/83; and a group which releases FA by coupling reaction with an oxidation product of an aromatic primary amine developing agent as described in, e.g., Japanese Patent Application (OPI) No. 111536/82. These reactions may be completed in one step or in multiple steps.

Further, the trivalent TIME group which is bonded to the coupling position and non-coupling position of Cp and FA as hereinbefore described is also preferred. Examples of such a trivalent TIME group is disclosed in Japanese Patent Application (OPI) No. 209740/83 in which TIME is incorporated in a yellow coupler.

When FA contains AD—(L)$_m$—X, AD may be directly bonded to a carbon atom of the coupling position, or either L or X, if releasable upon coupling reaction, may be bonded to the coupling carbon atom. Further, a so-called 2-equivalent coupling-off group may be present between the coupling carbon and AD.

These FA groups can include an alkoxy group (e.g., a methoxy group), an aryloxy group (e.g., a phenoxy group), an alkylthio group (e.g., an ethylthio group), an arylthio group (e.g., a phenylthio group), a heterocyclic oxy group (e.g., a tetrazolyloxy group), a heterocyclic thio group (e.g., a pyridylthio group), a heterocyclic group (e.g., a hydantoinyl group, a pyrazolyl group, a triazolyl group, a benzotriazolyl group, etc.), and the like. In addition, those described in British Pat. No. 2,011,391 can also be used as FA.

The group adsorptive onto silver halide grains as represented by AD can include a group derived from a nitrogen-containing heterocyclic ring having a dissociative hydrogen atom (e.g., pyrrole, imidazole, pyrazole, triazole, tetrazole, benzimidazole, benzopyrazole, benzotriazole, uracil, tetraazaindene, imidazotetrazole, pyrazolotriazole, pentaazaindene, etc.), a heterocyclic ring containing at least one nitrogen atom and other hetero atoms (e.g., an oxygen atom, a sulfur atom, a selenium atom, etc.) (e.g., oxazole, thiazole, thiazoline, thiazolidine, thiadiazole, benzothiazole, benzoxazole, benzoselenazole, etc.), a heterocyclic ring having a mercapto group (e.g., 2-mercaptobenzothiazole, 2-mercaptopyrimidine, 2-mercaptobenzoxazole, 1-phenyl-5-mercaptotetrazole, etc.), a quaternary salt (e.g., quaternary salts of tertiary amine, pyridine, quinoline, benzothiazole, benzimidazole or benzoxazole, etc.), a thiophenol, an alkylthiol (e.g., cysteine), and a compound having a partial structure of

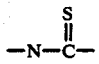

(e.g., thiourea, dithiocarbamate, thioamide, rhodanine, thiazolidinethione, thiohydantoin, thiobarbituric acid, etc.).

The divalent linking group as represented by L in FA is composed of a group selected from an alkylene group, an alkenylene group, a phenylene group, a naphthylene group, —O—, —S—, —SO—, —$SO_2$—, —N=N—, a carbonyl group, an amido group, a thioamido group, a sulfonamido group, a ureido group, a thioureido group, a heterocyclic group, etc. If a group capable of being cleaved by the action of a component of a developing solution, such as hydroxide ions, hydroxylamine, sulfite ions, etc., is selected as one of the divalent linking groups which constitute L, the fogging activity can be controlled or deactivated.

The group as represented by X can include groups derived from reducing compounds (e.g., hydrazine, hydrazide, hydrazone, hydroquinone, catechol, p-aminophenol, p-phenylenediamine, 1-phenyl-3-pyrazolidone, enamine, aldehyde, polyamine, acetylene, aminoboran, a quaternary salt such as a tetrazolium salt and an ethylene-bispyridinium salt, carbazic acid, etc.) and groups derived from compounds capable of forming silver sulfide upon development, such as compounds having a partial structure of

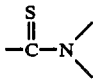

(e.g., thiourea, thioamide, dithiocarbamate, rhodanine, thiohydantoin, thiazolidinethione, etc.). Of these groups, some of those capable of forming silver sulfide upon development have absorptivity onto silver halide grains and, therefore, can serve as AD.

Particularly preferred FA can be represented by the following formulae (XXII) and (XXIII).

(XXII)

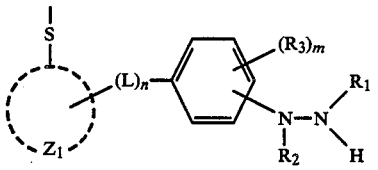

(XXIII)

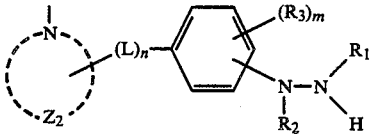

wherein $R_1$ represents an acyl group (e.g., a formyl group, an acetyl group, a propionyl group, a trifluoroacetyl group, a pyruvoyl group, etc.), a carbamoyl group (e.g., a dimethylcarbamoyl group, etc.), an alkylsulfonyl group (e.g., a methanesulfonyl group, etc.), an arylsulfonyl group (e.g., a benzenesulfonyl group, etc.), an alkoxycarbonyl group (e.g., a methoxycarbonyl group, etc.), an aryloxycarbonyl group (e.g., a phenoxycarbonyl group, etc.) or a sulfamoyl group (e.g., a methylsulfamoyl group, etc.); $R_2$ represents a hydrogen atom, an acyl group (e.g., a trifluoroacetyl group, etc.), an alkoxycarbonyl group (e.g., a methoxycarbonyl group, etc.) or an aryloxycarbonyl group (e.g., a phenoxycarbonyl group, etc.); $R_3$ represents a halogen atom (e.g., a fluorine atom, a chlorine atom, etc.), an alkoxy group (e.g., a methoxy group, a methoxyethoxy group, etc.), an alkyl group (e.g., a methyl group, a hydroxymethyl group, etc.), an alkenyl group (e.g., an allyl group, etc.), an aryl group (e.g., a phenyl group, etc.), an aryloxy group (e.g., a phenoxy group, etc.), an alkylthio group (e.g., a methylthio group, etc.), an arylthio group (e.g., a phenylthio group, etc.), a carbonamido group (e.g., an acetamido group, etc.) or a sulfonamido group (e.g., a methanesulfonamido group, etc.); m represents 0 or an integer of from 1 to 4; when m is 2 or more, $R_3$ may be the same or different or two or more of them may be taken together to form a condensed ring; L is a divalent group as defined above; n represents 0 or 1; $Z_1$ represents a monocyclic or condensed hetero ring; and $Z_2$ represents an atomic group necessary to form a monocyclic or condensed ring together with the

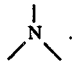

In the the formulae (XXII) and (XXIII), specific examples of the monocyclic or condensed hetero rings formed by

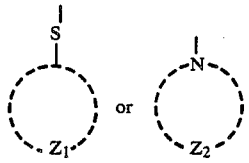

will be shown in examples of AD hereinafter given.

Examples of FR compounds which can be used in the present invention are described in, e.g., Japanese Patent Application (OPI) Nos. 150845/82, 50439/84, 177638/84 and 170840/84.

Specific examples of AD are shown below. In the following formulae, the free bonds are bonded to —(L-)$_m$—X and —(TIME)$_n$—.

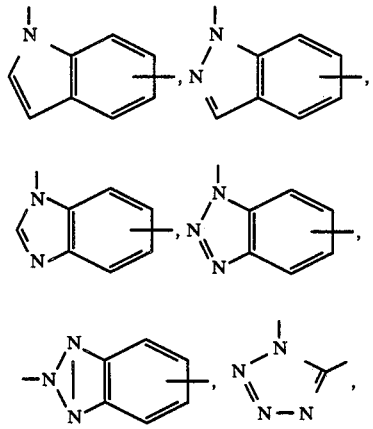

-continued
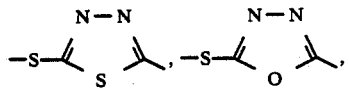
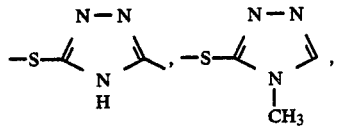
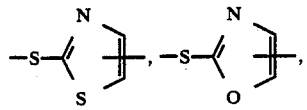
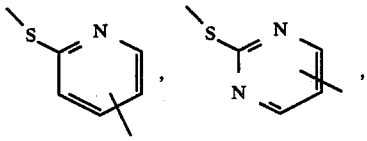
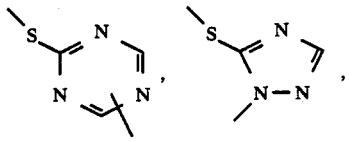
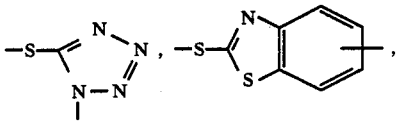
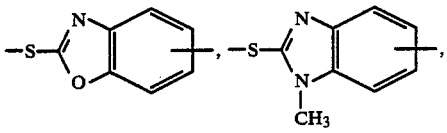
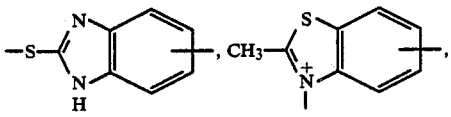
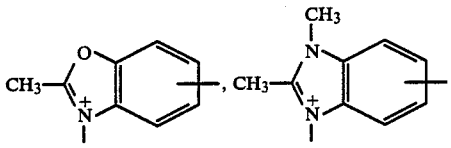
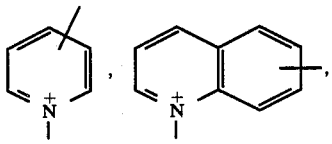
-continued
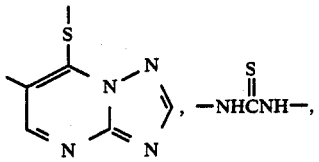
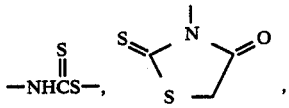
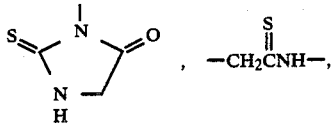
Specific examples of L are shown below.
$-CH_2-$, $-CH_2CH_2-$, $-OCH_2-$, $-OCH_2CH_2-$,
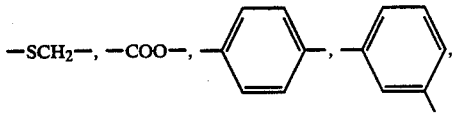
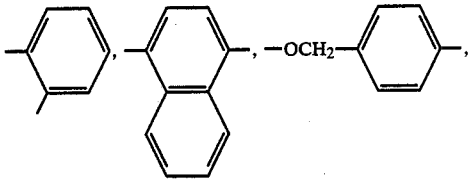
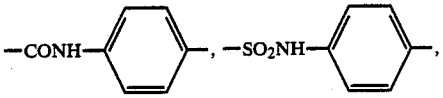
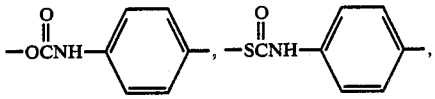
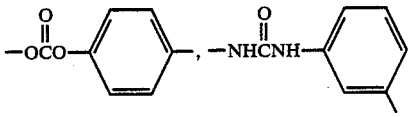
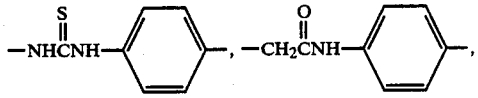
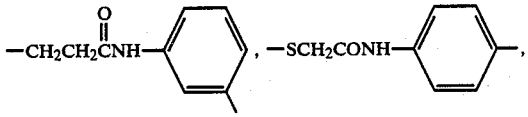

-continued
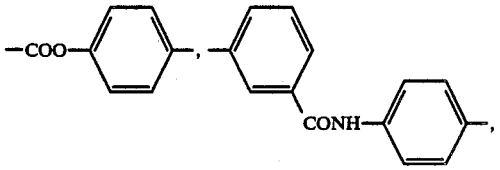
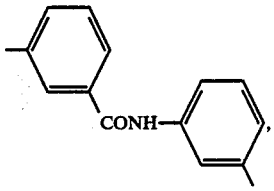
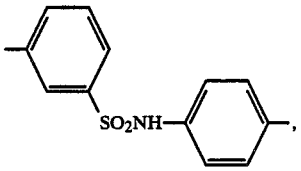
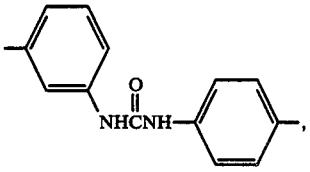
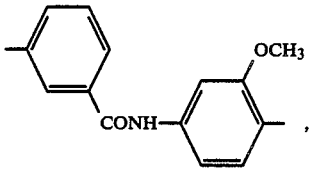
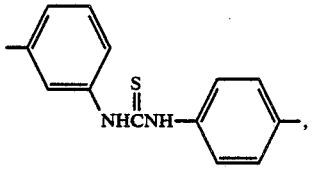
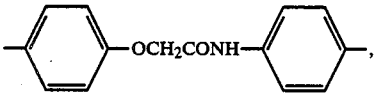
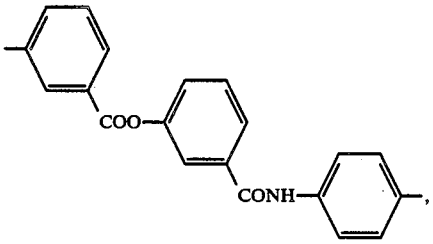
-continued
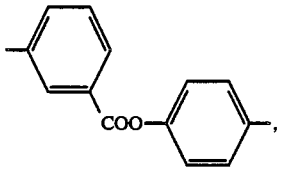
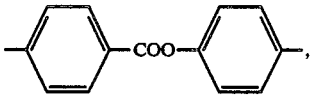
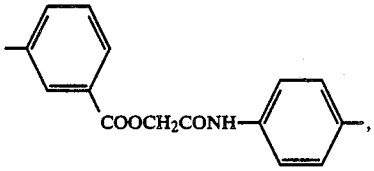
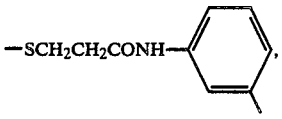
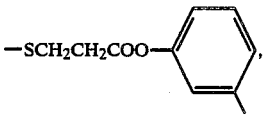
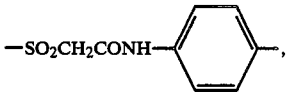
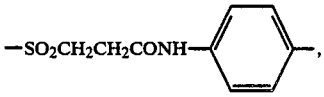
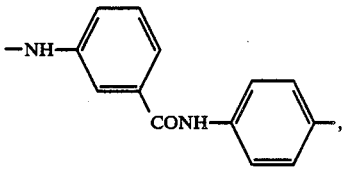
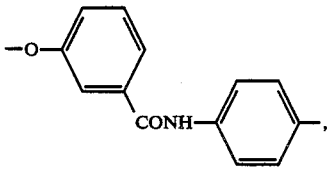
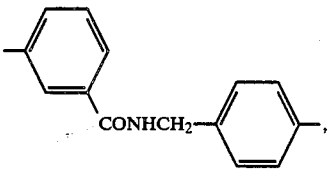
Specific examples of X are shown below.

—NHNHCHO, —NHNHCOCH$_3$, —NHNHSO$_2$CH$_3$,
—NHNHCOCF$_3$, —N(COOC$_2$H$_5$)—NHCHO,
—CONHNH—C$_6$H$_4$—CH$_3$,
—CONHNH—C$_6$H$_4$—OCH$_3$,
—C(=N—NH—C$_6$H$_4$—CH$_3$)—,
—CONHNHCH$_3$, —CONHNH$_2$,
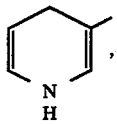 , —C≡C—H, —CHO,
—NHC(=S)NHCH$_3$, —C(=S)NH—C$_6$H$_4$—,
—S—C(=S)NHCH$_3$, 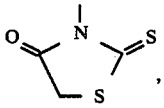 ,
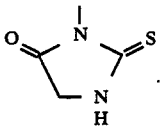 .
Specific examples of preferred FA groups in the aforesaid formulae (1) to (3) are shown below.
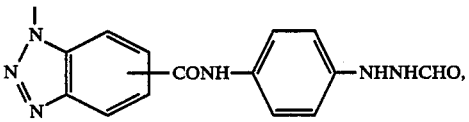
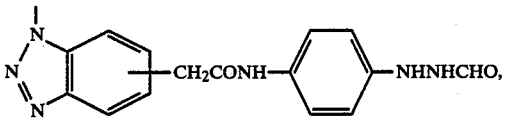
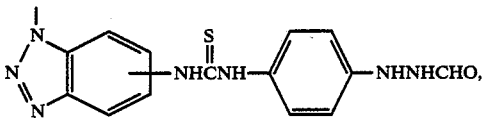
-continued
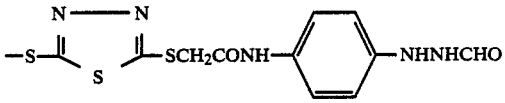
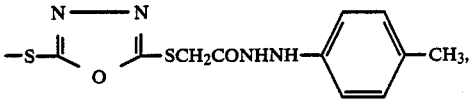
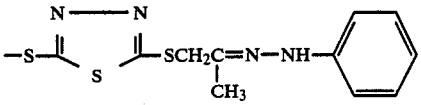
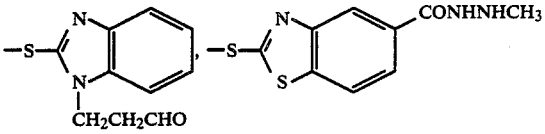
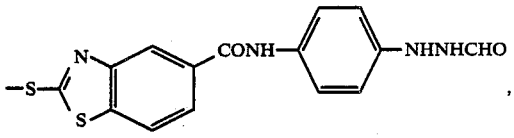
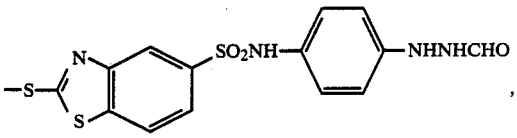
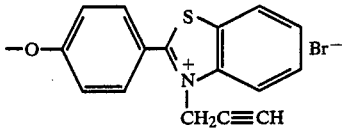
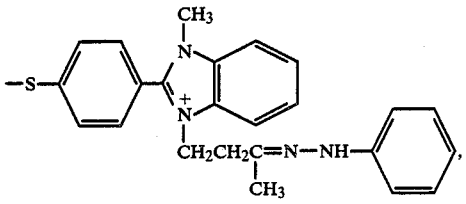
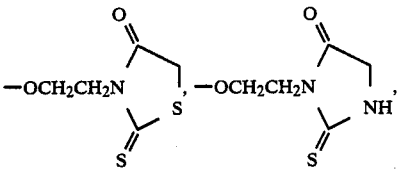
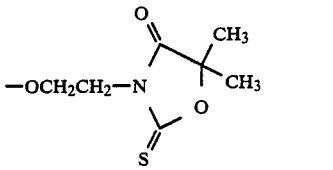

-continued
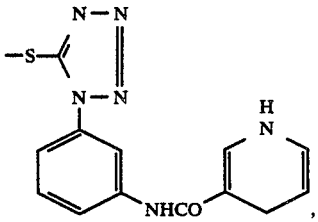
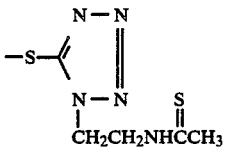
Specific examples of the compounds which can be used in the present invention are shown below.
(I-1)
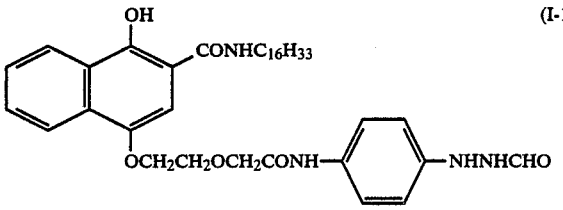
(I-2)
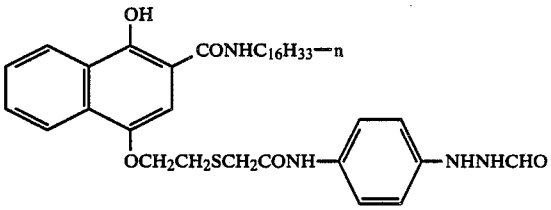
(I-3)
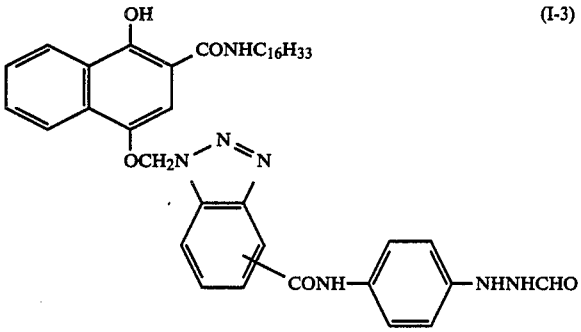
(I-4)
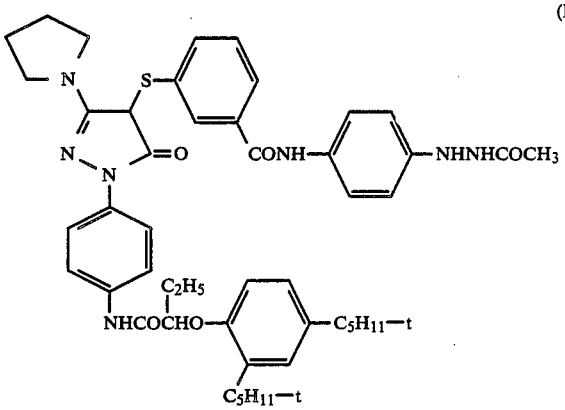
(I-5)
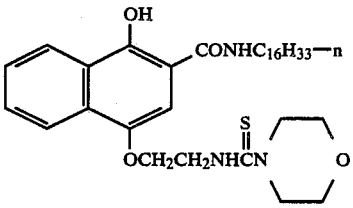
(I-6)
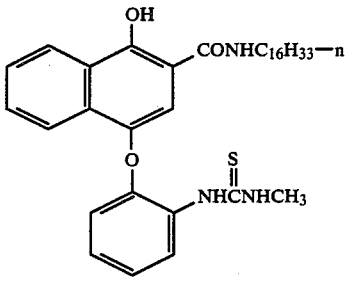
(I-7)
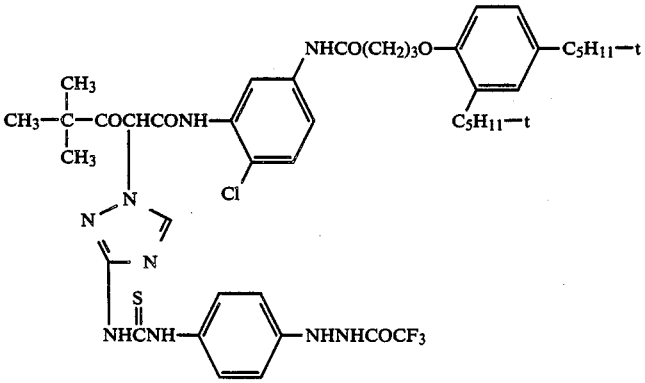

-continued
(I-8)
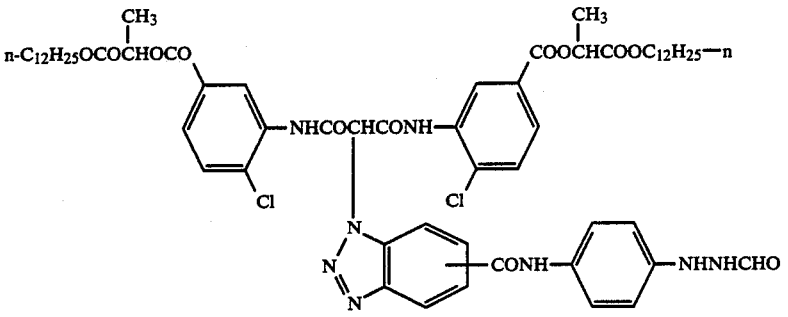
(I-9)
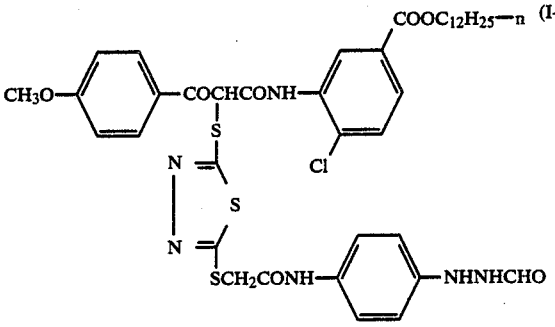
(I-10)
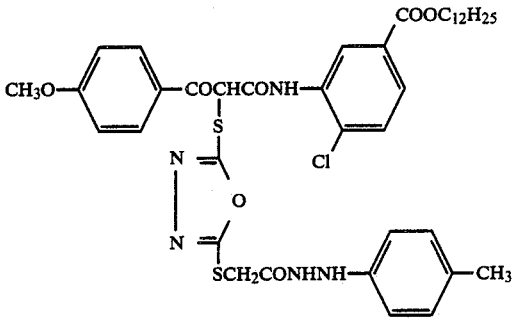
(I-11)
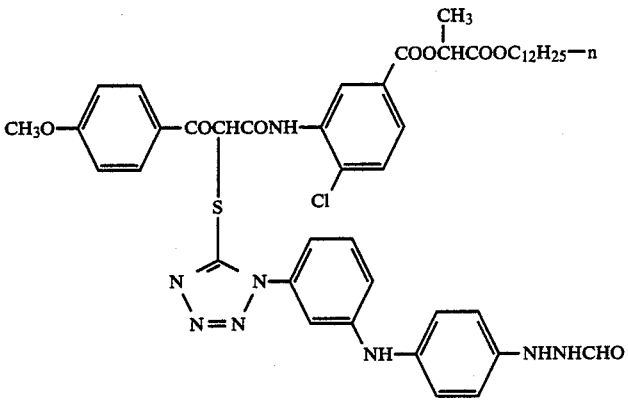
(I-12)
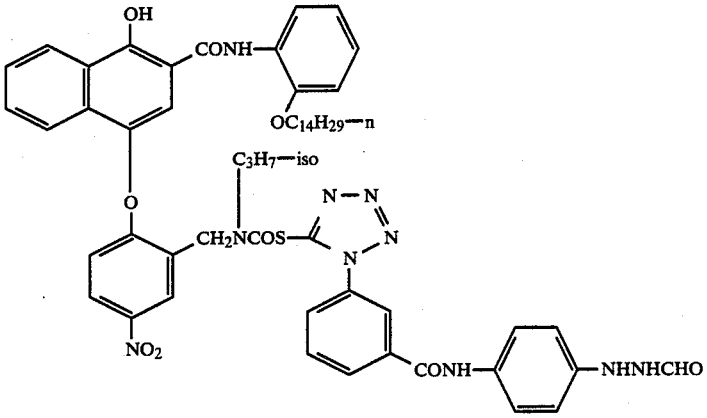

-continued
(I-13)
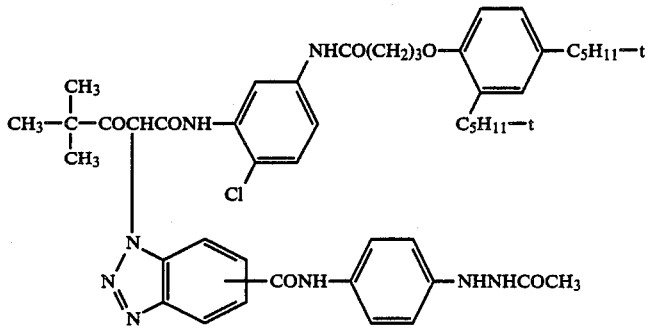
(I-14)
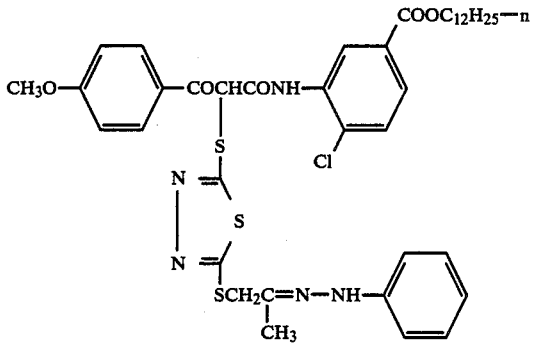
(I-15)
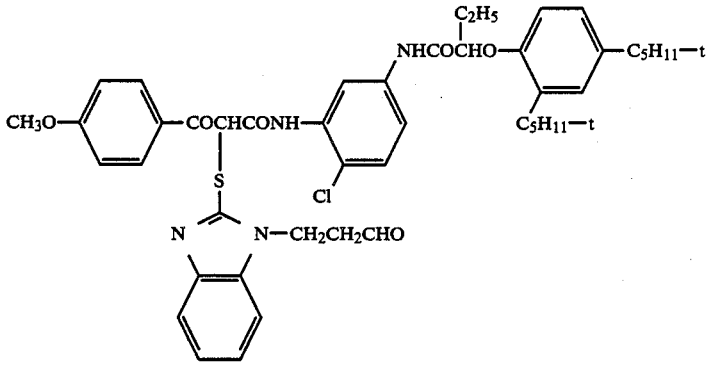
(I-16)
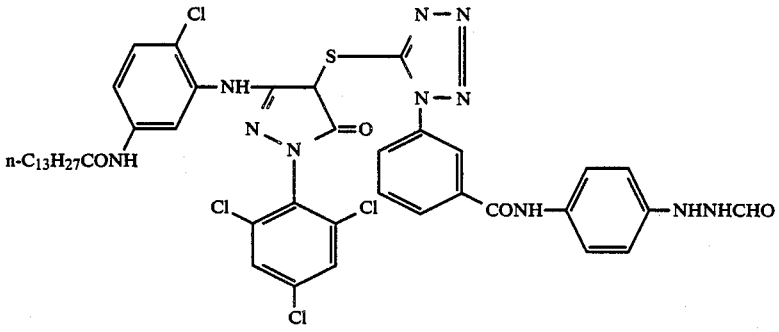

-continued
(I-17)
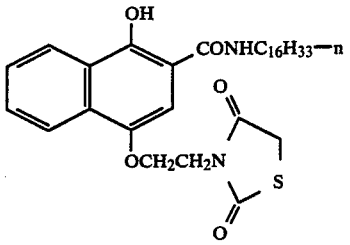
(I-18)
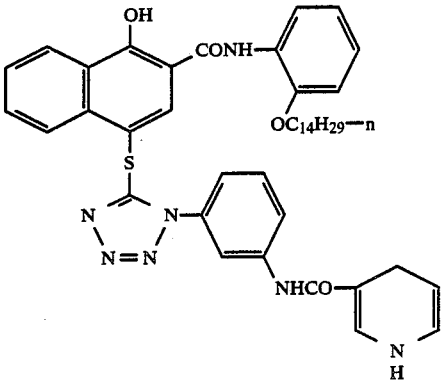
(I-19)
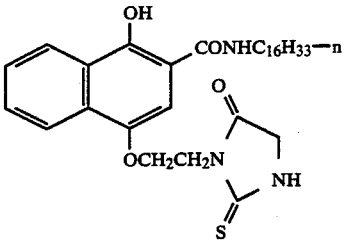
(I-20)
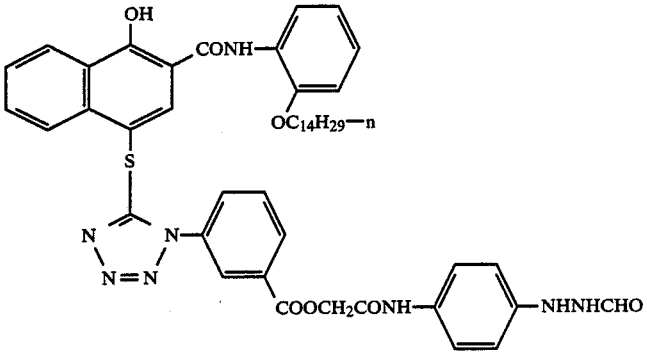
(I-21)
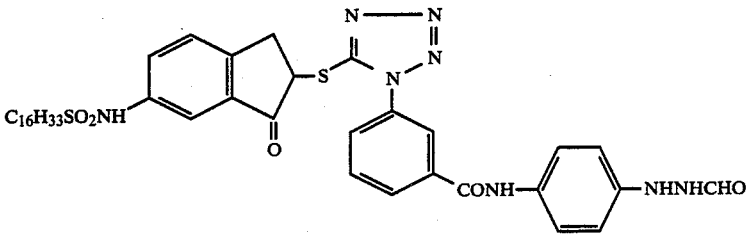
(I-22)
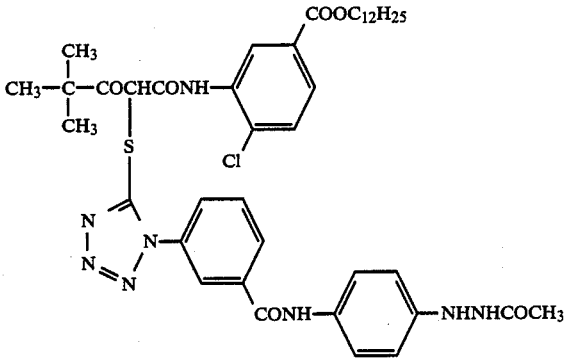

-continued
(I-23)
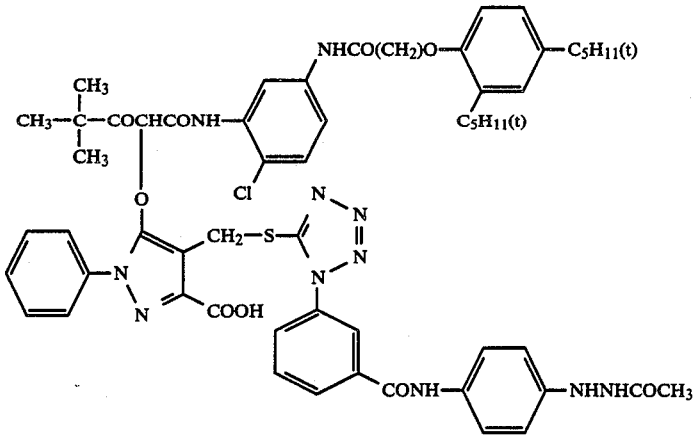
(I-24)
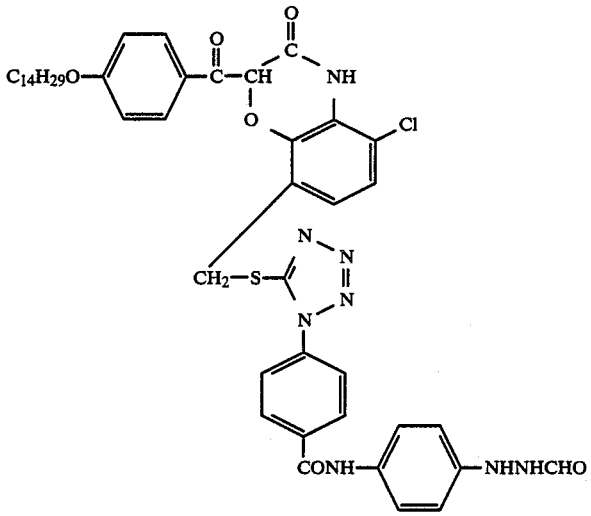
(I-25)
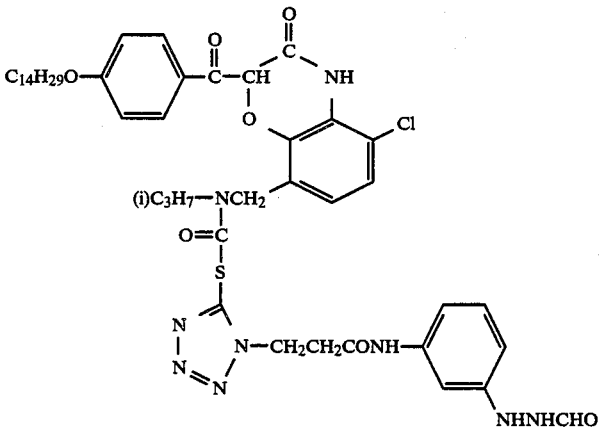

-continued
(I-26)
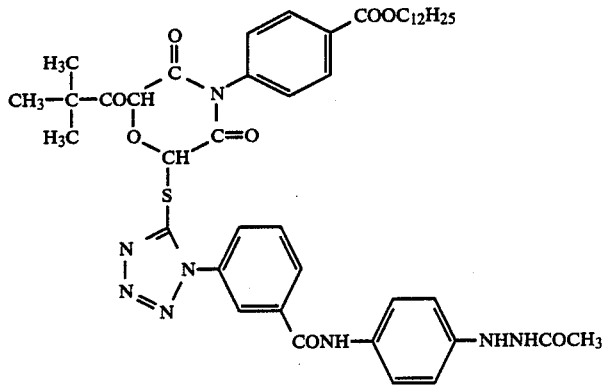
(I-27)
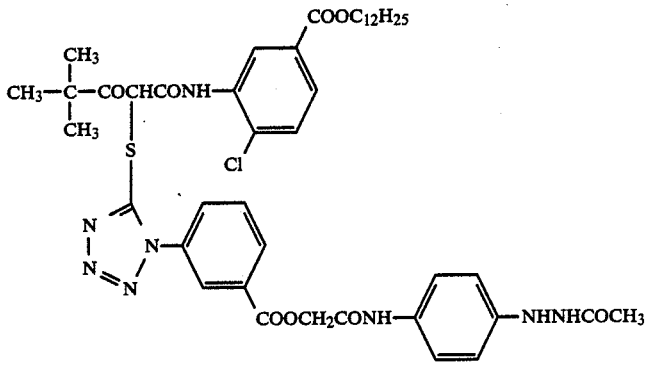
(I-28)
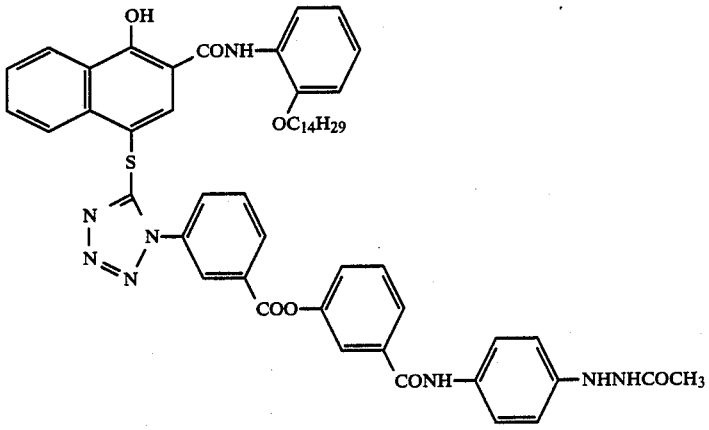
(II-1)
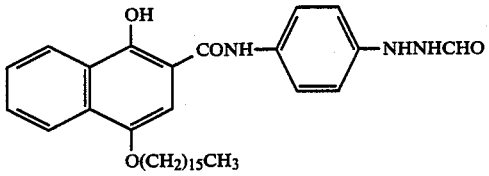
(II-2)
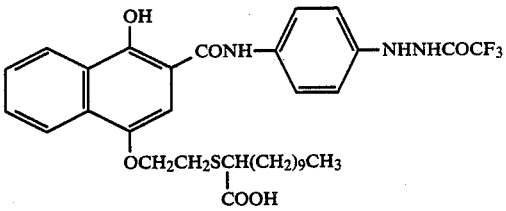
(II-3)
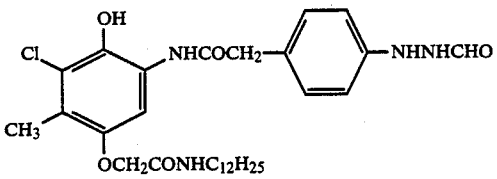
(II-4)
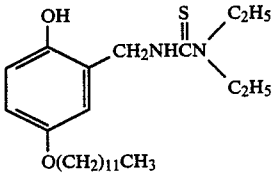

-continued
(II-5)
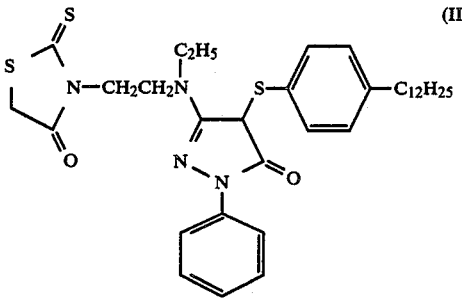
(II-6)
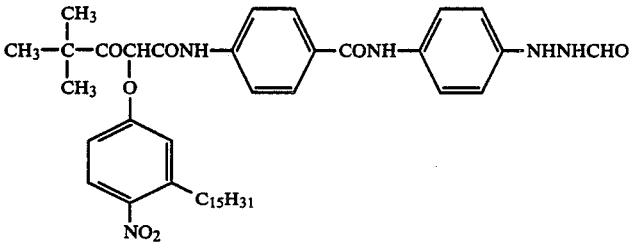
(II-7)
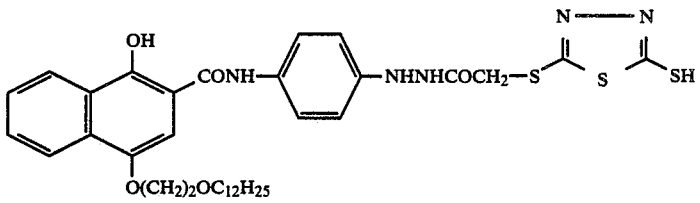
(II-8)
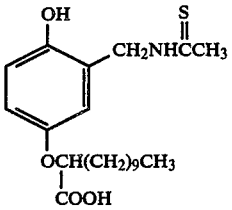
(III-1)
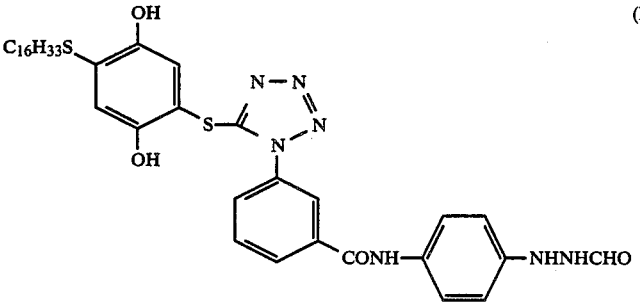
(III-2)
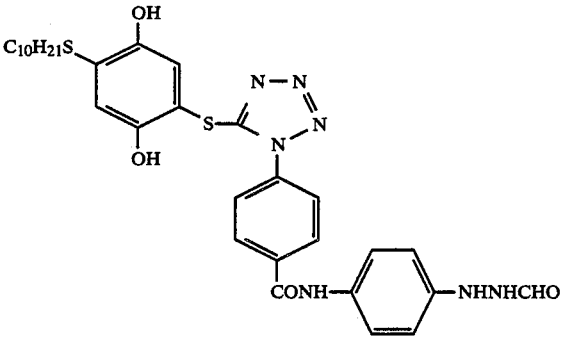
(III-3)
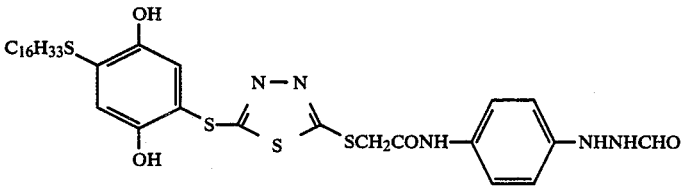
(III-4)
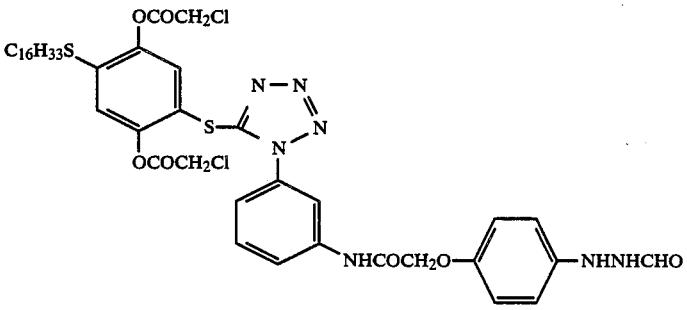

-continued
(III-5)
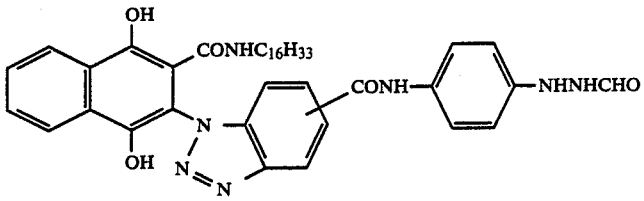
(III-6)
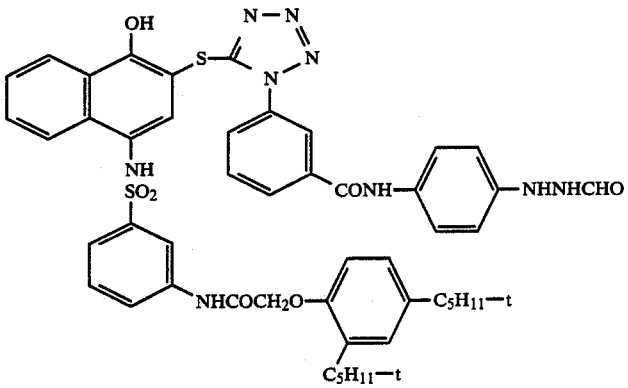
(III-7)
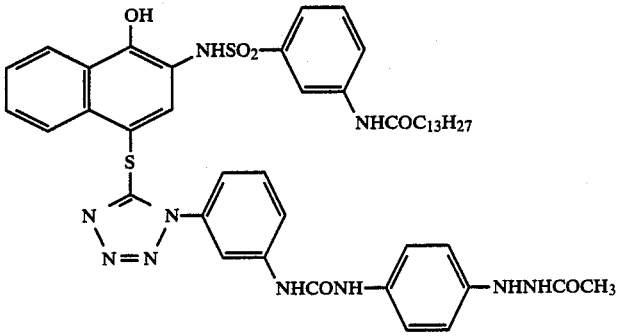
(III-8)
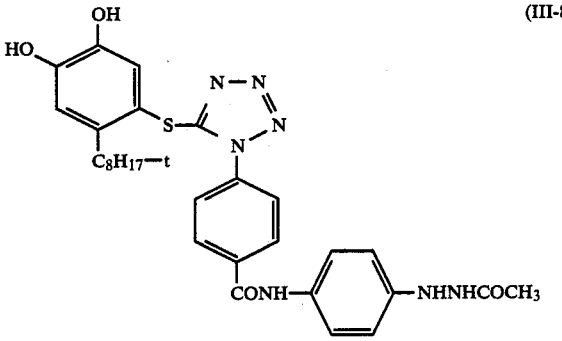
(III-9)
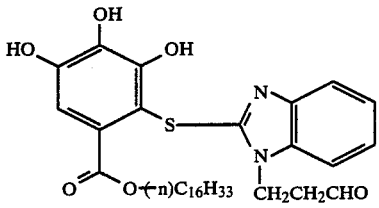
(III-10)
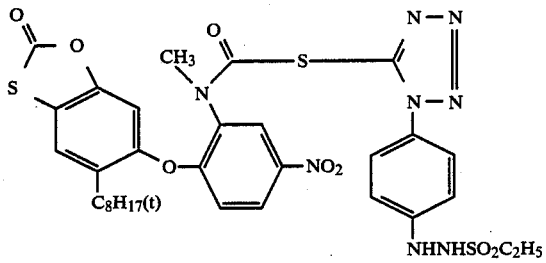
These compounds of the present invention can be synthesized from known compounds using methods as described in Japanese Patent Application (OPI) Nos. 150845/82 and 138636/82, U.S. Pat. Nos. 3,214,377 and 3,253,924, Japanese Patent Application (OPI) No. 50439/84, etc.

The projected area of gigantic silver halide grains used in the present invention means a projected area obtained from microphotography using a well known method in the art (usually electron microscopic photography) as described in T. H. James, *The Theory of the Photographic Process,* 3rd Ed., pages 36 to 43 (1966). Also, the diameter corresponding to the projected area of silver halide grains is defined as a diameter of a circle which has an area equal to the projected area of silver halide grains.

The HG emulsion used in the present invention is necessary to have a diameter corresponding to the projected area of a group of silver halide grains that take 40% of the total projected area of silver halide grains as integrated from large-sized grains of 1.5 μm or more. The diameter is preferably 1.7 μm or more, more preferably 1.8 μm or more and most preferably 2.0 μm or more. Further, it is necessary that the diameter corresponding to the projected area of grains that takes 40% or more of the projected area of whole silver halide grains is 1.5 μm or more. Preferably the diameter of grains that take 50% or more is 1.5 μm or and more preferably the diameter of grains that take 70% or more is 1.5 μm or more.

The grain size distribution of the emulsion may be narrow or broad.

The HG emulsion used present invention can be prepared by various methods. That is, any of an acid process, a neutral process, an ammonia process, etc., can be employed. Soluble silver salts and soluble halogen salts can be reacted by techniques such as a single jet process, a double jet process, and a combination thereof. As one system of the double jet process, a so-called controlled double jet process in which the pAg in a liquid phase where silver halide is formed is maintained at a predetermined level can be employed. In preparing the HG emulsion, it is preferred that silver halide solvents such as ammonia, rhodan salts, thioureas, and amines be used if desired. These silver halide solvents are described in T. H. James ed., *The Theory of the Photographic Process,* 4th ed., MacMillan Publishing Co., Inc., page 9. A grain-forming method in which the rates of addition of reactants such as soluble silver salts and soluble halides are increased with a lapse of time, and a grain-forming method in which the concentrations of the reactants are increased with a lapse of time are also useful in preparation of the HG emulsion.

Silver halides for the HG emulsion may be any of silver chloride, silver bromide, silver chlorobromide, silver iodobromide, silver chloroiodobromide, etc. Silver halide grains are preferred in which the silver bromide content is at least 60%, the silver chloride content is less than 30%, and the silver halide content is less than 30%. Particularly preferred is silver iodobromide containing from 2 to 25 mol%, preferably from 6 to 20 mol%, and more preferably from 10 to 20 mol%, of silver iodide.

Silver halide grains for the HG emulsion may have any desired crystal shape, such as a regular crystal shape (e.g., a hexahedron, an octahedron, a dodecahedron, and a tetradecahedron), and an irregular crystal shape (e.g., a sphere, a pebble-like form, and a tabular form). Tablular grains in which the aspect ratio as defined in *Research Disclosure,* RD-22534 (1983) is at least 5 are preferably used in the present invention.

The gigantic silver halide grains of the present invention may be each composed of an inner portion (core) and a surface layer (shell), which are different from each other in composition, or the composition may be uniform through the gigantic silver halide grain. Furthermore, the grains may be such that a latent image is formed mainly on the surface, or such that a latent image is formed mainly in the inside thereof. Two or more silver halide emulsions prepared independently may be mixed and used as the HG emulsion of the present invention.

The formation or physical ripening of gigantic silver halide grains may be carried out in the presence of cadmium salts, zinc salts, lead salts, thallium salts, iridium salts or its complex salts, rhodium salts or its complex salts, iron salts or its complex salts, and the like.

For removal of soluble salts from the emulsion after precipitate formation or physical ripening, a noodle washing process in which gelatin is gelated may be used. In addition, a fluocculation process utilizing inorganic salts, anionic surface active agents, anionic polymers (e.g., polystyrenesulfonic acid, etc.), or gelatin derivatives (e.g., acylated gelatin, carbamoylated gelatin, etc.) may be used.

Silver halide emulsions are usually chemically sensitized. For this chemical sensitization, for example, the methods as described in H. Frieser ed., *Die Grundlagen der Photographischen Prozesse mit Silver-halogeniden,* Akademische Verlagsgesselschaft, pages 675 to 734 (1968) can be used; sulfur sensitization using active gelatin or compounds (e.g., thiosulfates, thioureas, mercapto compounds, rhodanines, etc.) containing sulfur capable of reacting with silver, reduction sensitization using reducing substances (e.g., stannous salts, amines, hydrazine derivatives, formamidinesulfinic acid, silane compounds, etc.) noble metal sensitization using noble metal compounds (e.g., complex salts of Group VIII metals in the Periodic Table, such as Pt, Ir, Pd, etc., as well as gold complex salts), and so forth can be applied alone or in combination with each other.

More specifically, the sulfur sensitization process is described in, for example, U.S. Pat. Nos. 1,574,944, 2,410,689, 2,278,947, 2,728,668 and 3,656,955, etc.; the reduction sensitization process, in, for example, U.S. Pat. Nos. 2,983,609, 2,419,974 and 4,054,458, etc.; and the noble metal sensitization process, in, for example, U.S. Pat. Nos. 2,399,083 and 2,448,060, British Pat. No. 618,061, etc.

Photographic emulsions used in the present invention may include various compounds for the purpose of preventing fog formation or of stabilizing photographic performance in the photographic light-sensitive material during the production, storage or photographic processing thereof. For example, those compounds known as antifoggants or stabilizers can be incorporated, including azoles such as benzothiazolium salts, nitroindazoles, triazoles, benzotriazoles, benzimidazoles (particularly nitro- or halogen-substituted compounds, etc.); heterocyclic mercapto compounds such as mercaptothiazoles, mercaptobenzothiazoles, mercaptobenzimidazoles, mercaptothiadiazoles, mercaptotetrazoles (particularly 1-phenyl-5-mercaptotetrazole), mercaptopyridines, etc.; the foregoing heterocyclic mercapto compounds further containing a water-soluble group, e.g., a carboxy group of a sulfo group, etc.; thioketo compounds such as oxazolinethione, etc.; azaindenes such as tetraazaindenes (particularly 4-hydroxy-substituted (1,3,3a,7)-tetraazaindenes), etc.; benzenethiosulfonic acids; benzene sulfinic acid, and so on.

In connection with specific examples and methods of using them, the description, for example, in U.S. Pat.

Nos. 3,954,474, 3,982,947 and 4,021,248, Japanese Patent Publication No. 28660/77, etc. can be referred to.

The amount of the FR compound used is from $1\times10^{-8}$ to 0.5 mol, preferably from $5\times10^{-7}$ to $1\times10^{-2}$ mol, per mol of gigantic silver halide grains.

In the photographic emulsion layers of the photographic material produced in accordance with one embodiment of the present invention, dye forming couplers, that is, compounds capable of forming color by oxidative coupling with aromatic primary amine developers (e.g., phenylenediamine derivatives, aminophenol derivatives, etc.) in color development processing, may be used together with the compounds of the present invention. For example, suitable magenta couplers which may be used include 5-pyrazolone couplers, pyrazolobenzimidazole couplers, cyanoacetylcumarone couplers, open chain acylacetonitrile couplers and so on. Suitable yellow couplers which may be used include acylacetamide couplers (e.g., benzoylacetanilides, pivaloylacetanilides, etc.) and so on, and suitable cyan couplers which may be used include naphthol couplers, phenol couplers and so on. Of such couplers, nondiffusible ones having hydrophobic groups (ballast groups) in their molecules and polymeric couplers are preferred. These couplers may be either 4-equivalent or 2-equivalent to silver ions. In addition, colored couplers having a color correcting effect and couplers capable of releasing development inhibitors upon development (DIR couplers) may be used.

Besides DIR couplers, colorless DIR coupling compounds which yield colorless products upon coupling reaction and which release development inhibitors may be present.

Further, compounds capable of releasing development inhibitors upon development, other than DIR couplers, may be present in the photosensitive material.

The above described couplers and like compounds can be used as a combination of two or more thereof and can be incorporated in the same layer with the intention of satisfying various characteristics required of the photosensitive material. Of course, the same compound may also be incorporated into two or more different layers.

It is preferred that cyan dyes formed from cyan color forming agents have their respective maximal absorption bands in the range of about 600 to 720 nm, magenta dyes formed from magenta color forming agents have their respective maximal absorption bands in the range of about 500 to 580 nm, and yellow dyes formed from yellow color forming agents have their respective maximal absorption bands in the range of about 400 to 480 nm.

The light-sensitive material of the present invention can be used, for example, as a color negative film, a color paper, a color positive film, a color reversal film for slides, a color reversal film for movies, or as a color reversal film for TV. When the light-sensitive material is used as color negative films required to have high sensitivity and high image quality, or as various color reversal film, there can be obtained significant effects that the sensitivity is increased, the graininess is improved, and the processing is accelerated.

The light-sensitive material of the present invention can be used as a black-and-white light-sensitive material. When the light-sensitive malterial is used, in particular, as a high sensitivity black-and-white light-sensitive material, super sensitivity and rapid photographic processing can be achieved. Also, when the light-sensitive material is used as a photomechanical processing light-sensitive material, images of high contrast can be produced rapidly.

The present invention can be applied to a light-sensitive material using a black-forming coupler process and a three-color coupler process. The black-forming coupler process is described in detail in U.S. Pat. Nos. 3,622,629, 3,734,735 and 4,126,461 and Japanese Patent Application (OPI) Nos. 105247/80, 42725/77 and 105248/80. The three-color coupler mixing process is described in detail in *Research Disclosure,* 1712. If these processes are applied to an X-ray film, for example, there can be obtained significant effects that the amount of silver coated can be reduced, the processing can be performed rapidly, and the dose of X-ray can be reduced because of its high sensitivity.

The present invention can be applied to a black-and-white or color diffusion transfer light-sensitive material. Silver halide of both the direct reversal or negative types can be used..

The present invention can also be applied to a multilayer multicolor photographic material which has at least two different spectral sensitivities on a support. The multilayer color photographic material usually has, on a support, at least one red-sensitive emulsion layer, at least one green-sensitive emulsion layer, and at least one blue-sensitive emulsion layer. These layers may be arranged in any order as desired. It is usual that a cyan forming coupler, a magenta forming coupler and a yellow forming coupler are incorporated in a red-sensitive emulsion layer, a green-sensitive emulsion layer and a blue-sensitive emulsion layer, respectively. Different combinations can also be used, however, if circumstances require.

Application of the present invention to a light-sensitive material carrying at least two emulsion layers sensitive to the same color but different in sensitivity is especially advantageous in increasing its sensitivity. British Pat. No. 923,045 may be referred to in this respect. Incorporation of the FR compound in emulsion layers other than the layer of lowest sensitivity is particularly advantageous so as to increase sensitivity. In a light-sensitive material carrying at least three layers sensitive to the same color but different in sensitivity, the incorporation of the FR compound in emulsion layers other than the layer of lowest sensitivity is advantageous not only to increase sensitivity but also to improve graininess. With regard to the reason for this, Japanese Patent Publication No. 15495/74 can be referred to.

It is of greater advantage to use gelatin as a binder or protective colloid used in emulsion layers or interlayers of the photosensitive material of the present invention. Of course, hydrophilic colloids other than gelatin may also be used.

Photographic emulsion layers and other hydrophilic colloid layers of the photosensitive material produced in accordance with one embodiment of the present invention may contain various surface active agents for a wide variety of purposes, for example, as a coating aid, to prevent the generation of static charges, to improve slippability, to emulsify a dispersion, to prevent the generation of adhesiveness, to improve photographic characteristics (e.g., development acceleration, increase in contrast, sensitization, etc.), and so on.

The photographic emulsion layers of the photosensitive material of the present invention may contain, for example, polyalkylene oxides and ethers, esters and amine derivatives thereof, thioether compounds, thiomorpholines, quaternary ammonium salt compounds, urethane derivatives, urea derivatives, imidazole derivatives, 3-pyrazolidones and so on in order to increase the sensitivity and contrast thereof, or in order to accelerate the developing rate thereof.

The photographic emulsion layers and other hydrophilic colloid layers of the photographic material employed in the present invention can contain a dispersion of a water-insoluble or slightly soluble synthetic polymer for purposes of improving dimensional stability and so on. Suitable examples of such synthetic polymers include those containing, as a monomer component, an alkyl(meth)acrylate, an alkoxyalkyl(meth)acrylate, glycidyl(meth)acrylate, (meth)acrylamide, a vinyl ester (e.g., vinyl acetate), acrylonitrile, an olefin, a styrene and so on, individually or as a combination of two or more thereof, or a combination of one or more of these monomers with another monomer such as acrylic acid, methacrylic acid, an $\alpha,\beta$-unsaturated dicarboxylic acid, a hydroxyalkyl(meth)acrylate, a sulfoalkyl(meth)acrylate, a styrenesulfonic acid, etc.

In the photographic processing of the layer of a photographic emulsion prepared in accordance with the present invention, any known processing method and any known processing solution, as described in, e.g., *Research Disclosure,* Vol. 176, pp. 28–30 (December 1976), can be employed. This photographic processing may be either a photographic processing for forming a silver image (black-and-white photographic processing) or a photographic processing for forming a dye image (color photographic processing), depending upon the end use/purpose of the photographic material. The processing temperature is generally in the range of about 18° C. to about 50° C. Of course, temperatures higher than about 50° C. or lower than about 18° C. may be employed.

Fixing solutions having conventional compositions can be used in the present invention. Suitable fixing agents which can be used include not only thiosulfates and thiocyanates but also organic sulfur compounds which are known to have a fixing effect. The fixing solution may also contain water-soluble aluminum salts as a hardener.

Color images can be formed using conventional methods. For instance, a negative-positive process (as described in, e.g., *Journal of the Society of Motion Picture and Television Engineers,* Vol. 61, pp. 667–701 (1953)) and so on can be employed.

A color developing solution is, in general, an alkaline aqueous solution containing a color developing agent. Suitable examples of color developing agents which can be used include known aromatic primary amine developers, such as phenylenediamines (e.g., 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfonamidoethylaniline, 4-amino-3-methyl-N-ethyl-N-$\beta$-methoxyethylaniline, etc.) and so on.

In addition to the above described color developing agents, those described in L. F. A. Mason, *Photographic Processing Chemistry,* pp. 226–229, Focal Press, London (1966), U.S. Pat. Nos. 2,193,015 and 2,592,364 and Japanese Patent Application (OPI) No. 64933/73 and so on may also be employed.

The color developing solution can contain, in addition to the above described color developing agent, pH buffering agents such as sulfites, carbonates, borates and phosphates of alkali metals, development inhibitors or antifoggants such as bromides, iodides and organic antifoggants, and so on. Optionally, the color developing solution may contain water softeners, preservatives like hydroxylamine, organic solvents like benzyl alcohol and diethylene glycol, development accelerators like polyethylene glycol, quaternary ammonium salts and amines, dye forming couplers, competing couplers, fogging agents like sodium borohydride, auxiliary developers like 1-phenyl-3-pyrazolidone, viscosity imparting agents, chelating agents of the polycarboxylic acid type, anti-oxidizing agents, and so on.

The photographic emulsion layers which have been color development processed are generally subjected to a bleach processing. The bleach processing may be carried out either simultaneously with or separately from fixing processing. Suitable examples of bleaching agents which can be used include compounds of polyvalent metals such as FE (III), Co (III), Cr (VI), Cu (II), etc., peroxy acids, quinones, nitroso compounds and so on.

For example, ferricyanides, bichromates, organic complex salts of Fe (III) or Co (III) such as the complex salts of organic acids like aminopolycarboxylic acids (e.g., ethylenediaminetetraacetic acid, nitrilotriacetic acid, 1,3-diamino-2-propanoltetraacetic acid, etc.), citric acid, tartaric acid, malic acid and so on, persulfates, permanganates, nitrosophenol and so on can be used as a bleaching agent. Of these compounds, potassium ferricyanide, sodium ethylenediaminetetraacetatoferrate (III) and ammonium ethylenediaminetetraacetatoferrate (III) are particularly useful. Ethylenediaminetetraacetatoiron (III) complex salts are useful in both an independent bleaching solution and a combined bleaching and fixing bath.

The photographic material of the present invention may contain inorganic or organic hardeners in the photographic emulsion layers or other hydrophilic colloid layers. For examples, chromium salts (e.g., chrome alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloylhexahydro-s-triazine, 1,3-vinylsulfonyl-2-propanol, etc.), active halogen compounds (e.g., 2,4-dichloro-6-hydroxy-s-triazine, etc.), mucochloric acids (e.g., mucochloric acid, mucophenoxychloric acid, etc.) and so on can be used alone or in combination.

When dyes and ultraviolet absorbing agents are contained in hydrophilic colloid layers of the photosensitive material produced in accordance with the present invention, they may be mordanted with a cationic polymer or the like.

The sensitive material produced in accordance with an embodiment of the present invention may contain, in a hydrophilic colloid layer(s) thereof, water-soluble dyes as a filter dye, or for purposes such as anti-irradiation, etc. Suitable examples of such dyes include oxonol dyes, hemioxonol dyes, styryl dyes, merocyanine dyes cyanine dyes and azo dyes. Of these dyes, oxonol dyes, hemioxonol dyes and merocyanine dyes are especially useful.

In the present invention, known discoloration inhibitors also can be used, and color dye stabilizing agents can also be used as alone or as a combination of two or more thereof. Examples of known discoloration inhibitors include hydroquinone derivatives, gallic acid derivatives, p-alkoxyphenols, p-oxyphenol derivatives and bisphenols.

The present invention is described in greater detail with reference to the following non-limiting examples.

EXAMPLE 1

Four types of silver halide emulsions, HG emulsions A and B (of the present invention) and conventional emulsions C and D (comparative examples), were prepared as follows.

To 1,000 ml of a 2% aqueous gelatin solution containing 0.37 mol of potassium bromide and 0.10 mol of potassium iodide was added 800 ml of an aqueous solution containing 0.33 mol of silver nitrate over 70 minutes while stirring at 80° C., and the resulting mixture was subjected to physical ripening for 20 minutes. Then 1,000 ml of an aqueous solution containing 0.67 mol of silver nitrate and 1,000 ml of an aqueous solution containing 0.74 mol of potassium bromide were added at the same time over 80 minutes. After removal of salts, $1\times10^{-5}$ mol of sodium thiosulfate and $2\times10^{-5}$ mol of chloroauric acid were added, and chemical sensitization was performed at 60° C. for 40 minutes. In this way, a silver iodobromide emulsion, HG emulsion A, containing 10 mol% of silver iodide 2,4 μm in average size was obtained.

A silver iodobromide emulsion, HG emulsion B, having an average size of 1.8 μm was prepared in the same manner as in HG emulsion A except that the temperature at which the grains were formed was lowered to 60° C. and the chemical sensitization period was lengthened by 20 minutes.

To 1,000 ml of a 2% aqueous gelatin solution containing 0.32 mol of potassium bromide and 0.10 mol of potasium iodide was added 800 ml of an aqueous solution containing 0.33 mol of silver nitrate over 20 minutes while stirring the aqueous gelatin solution at 70° C., and the resulting mixture was subjected to physical ripening for 20 minutes. Then 1,000 ml of an aqueous solution containing 0.67 mol of silver nitrate and 1,000 ml of an aqueous solution containing 0.7 mol of potassium bromide were added at the same time over 50 minutes. To the thus-prepared emulsion 1.2 μm in average size were added $2\times10^{-5}$ mol of sodium thiosulfate and $4\times10^{-5}$ mol of chloroauric acid, and chemical sensitization was applied at 60° C. for 50 minutes to obtain a silver iodobromide emulsion, Emulsion C.

A silver iodobromide emulsion, Emulsion D, was prepared in the same manner as in Emulsion C except that the temperature at which the grains were formed was lowered to 50° C. and the chemical sensitization period was lengthened by 30 minutes. The average size was 0.7 μm.

The term "average size" as used herein means an average value of the diameter corresponding to the projected area of a group of silver halide grains corresponding to 40% of the total projected area as integrated from grains having a large projected area with respect to the silver halide grains photographed by an electron microscope.

On a cellulose triacetate support were coated one of the emulsions are prepared above and an emulsion of a mixture of tricresyl phosphate and Coupler Cp-1 in an aqueous gelatin solution so that the amount of each constituent coated was as described below, to thereby produce a light-sensitive material, Sample 101.

SAMPLE 101

| | |
|---|---|
| (1) Emulsion layer | |
| Negative-type silver iodobromide emulsion (HG emulsion A) | 1.7 g/m² (calculated as silver) |
| Coupler Co-1 | 0.9 g/m² |
| Tricresyl phosphate | 1.8 g/m² |
| Gelatin | 2.0 g/m² |
| (2) Protective layer | |
| Sodium 2,4-dichloro-6-hydroxy-s-triazine | 0.08 g/m² |
| Gelatin | 2.0 g/m² |

In addition, Samples 102 to 112 were produced as follows.

SAMPLES 102 AND 103

FR compounds (I-11) and (I-13) of the present invention were added to the emulsion layer of Sample 101 both in an amount of 1.5 mg/m² to produce Samples 102 and 103, respectively.

SAMPLES 104 TO 112

Samples 104 to 106 were produced by replacing the HG emulsion A of Samples 101 to 103 by HG emulsion B.

Samples 107 to 109 were produced by replacing the HG emulsion A of Samples 101 to 103 by Emulsion C.

Samples 110 to 112 were produced by replacing the HG emulsion A of Samples 101 to 103 by Emulsion C.

Each material was exposed to light for sensitometry and color developed under the conditions as described below. The thus-processed material was measured for density by the use of a blue filter, and the results are shown in Table 1.

The color development was conducted at 38° C. under the following conditions.

| | |
|---|---|
| 1. Color development | 2.75 minutes |
| 2. Bleach | 6.5 minutes |
| 3. Water-washing | 3.25 minutes |
| 4. Fixing | 6.5 minutes |
| 5. Water-washing | 3.25 minutes |
| 6. Stabilization | 3.25 minutes |

The composition of a processing solution used at each step was as follows.

| Color Developer | Amount (g) |
|---|---|
| Sodium nitriloacetate | 1.0 |
| Sodium sulfite | 4.0 |
| Sodium carbonate | 30.0 |
| Potassium bromide | 1.4 |
| Hydroxyamine sulfate | 2.4 |
| 4-(N—ethyl-N—β-hydroxyethylamino)-2-methylaniline sulfate | 4.5 |
| Water to make | 1 liter |

| Bleaching Solution | Amount |
|---|---|
| Ammonium bromide | 160.0 g |
| Ammonia water (28%) | 25.0 ml |
| Sodium iron ethylenediaminetetraacetate | 130 g |
| Glacial acetic acid | 14 ml |

-continued

| Bleaching Solution | Amount |
|---|---|
| Water to make | 1 liter |

| Fixing Solution | Amount |
|---|---|
| Sodium tetrapolyphosphate | 2.0 g |
| Sodium sulfite | 4.0 g |
| Ammonium thiosulfate (70%) | 175.0 ml |
| Sodium hydrogensulfite | 4.6 g |
| Water to make | 1 liter |

| Stabilizer | Amount |
|---|---|
| Formalin | 8.0 ml |
| Water to make | 1 liter |

Coupler Cp-1 used in this example has the following chemical structure.

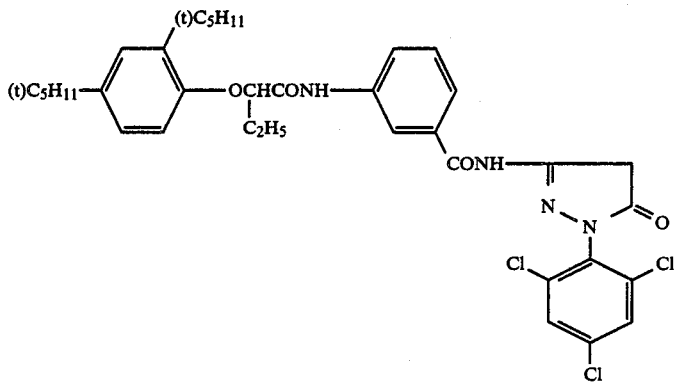

EXAMPLE 2

Emulsions A-1, A-2 and A-3 were prepared in the same manner as in the preparation of HG emulsion A of Example 1 except that the chemical sensitization period was lengthened by 10 minutes, 20 minutes, and 30 minutes, respectively.

Samples 201 to 203 were produced in the same manner as in the production of Sample 101 of Example 1 except that HG emulsion A was replaced by Emulsions A-1, A-2, and A-3, respectively.

Sample 101′ and Samples 201′ to 203′ were produced in the same manner as in the production of Sample 101 and Samples 201 to 203 except that FR Compound I-9 was added in an amount of 0.5 mg/m$^2$.

Each material was exposed to light for sensitometry and then color developed in the same manner as in Example 1.

In the FIGURE, sensitivity was plotted against for all the materials.

It can be seen from the FIGURE that in the materials with the FR compound added thereto, a high sensitivity can be attained which could not be obtained only by chemical sensitization of the usual emulsions.

TABLE 1

| Sample No. | Emulsion | FR Compound | Photographic Properties | |
|---|---|---|---|---|
| | | | Fog | Relative Sensitivity[1] |
| 101 (Comparative Example) | A | — | 0.07 | 100 |
| 102 (Example of the Invention) | A | 1 - 11 | 0.09 | 135 |
| 103 (Example of the Invention) | A | 1 - 13 | 0.09 | 141 |
| 104 (Comparative Example) | B | — | 0.06 | 100 |
| 105 (Example of the Invention) | B | 1 - 11 | 0.07 | 132 |
| 106 (Example of the Invention) | B | 1 - 13 | 0.07 | 135 |
| 107 (Comparative example) | C | — | 0.07 | 100 |
| 108 (Comparative example) | C | 1 - 11 | 0.08 | 117 |
| 109 (Comparative example) | C | 1 - 13 | 0.08 | 123 |
| 110 (Comparative example) | D | — | 0.05 | 100 |
| 111 (Comparative example) | D | 1 - 11 | 0.06 | 110 |
| 112 (Comparative example) | D | 1 - 13 | 0.06 | 114 |

(1) Relative sensitivity:

This is the reciprocal of an exposure amount to provide a density of fog +0.5 and expressed with that of Sample 101 as 100 when HG emulsion A was used, that of Sample 104 as 100 when HG emulsion B was used, that of Sample 107 as 100 when Emulsion C was used, and that of Sample 110 as 100 when Emulsion D was used.

It can be seen from Table 1 that HG emulsions A and B of the present invention greatly increase sensitivity compared with the usual emulsions, Emulsions C and D: this demonstrates the effectiveness of the present invention.

EXAMPLE 3

A multi-layer silver halide color photographic light-sensitive material of the layer structure as shown below, Sample 301, was produced using HG emulsion A as prepared in Example 1 and a triacetyl cellulose film provided with a snubbing layer.

Samples 302, 303, and 304 were produced in the same manner as in Sample 301 except that FR Compounds (I-9), (I-20), and (I-6), respectively, were added each in an amount of 0.001 g/m$^2$ to the 13th layer of Sample 301.

| 1st Layer: Antihalation Layer | |
|---|---|
| Gelatin layer containing: | |
| black colloidal silver | 0.18 g/m$^2$ |
| ultraviolet absorber C-1 | 0.12 g/m$^2$ |
| ultraviolet absorber C-2 | 0.17 g/m$^2$ |

| 2nd Layer: Interlayer | |
|---|---|
| Gelatin layer containing: | |
| 2,5-di-tert-pentadecylhydroquinone | 0.18 g/m$^2$ |
| Coupler C-3 | 0.11 g/m$^2$ |
| silver iodobromide emulsion (silver iodide: 1 mol %; average grain size: 0.07 μm) | 0.15 g/m$^2$ (calculated as silver) |

| 3rd Layer: First Red-Sensitive Emulsion Layer | |
|---|---|
| Gelatin layer containing: | |
| silver iodobromide emulsion (silver iodide: 6 mol %; average grain size: 0.6 μm) | 0.72 g/m$^2$ (calculated as silver) |
| Sensitizing Dye I | $7.0 \times 10^{-5}$ mol per mol of silver |
| Sensitizing Dye II | $2.0 \times 10^{-5}$ mol per mol of silver |
| Sensitizing Dye III | $2.8 \times 10^{-4}$ mol per mol of silver |
| Sensitizing Dye IV | $2.0 \times 10^{-5}$ mol per mol of silver |
| Coupler C-4 | 0.93 g/m$^2$ |
| Coupler C-5 | 0.31 g/m$^2$ |
| Coupler C-6 | 0.010 g/m$^2$ |

| 4th Layer: Second Red-Sensitive Emulsion Layer | |
|---|---|
| Gelatin layer containing: | |
| silver iodobromide emulsion (silver iodide: 10 mol %; average grain size: 1.6 μm) | 1.6 g/m$^2$ (calculated as silver) |
| Sensitizing Dye I | $5.2 \times 10^{-5}$ mol per mol of silver |
| Sensitizing Dye II | $1.5 \times 10^{-5}$ mol per mol of silver |
| Sensitizing Dye III | $2.1 \times 10^{-4}$ mol per mol of silver |
| Sensitizing Dye IV | $1.5 \times 10^{-5}$ mol per mol of silver |
| Coupler C-4 | 0.10 g/m$^2$ |
| Coupler C-5 | 0.061 g/m$^2$ |
| Coupler C-6 | 0.005 g/m$^2$ |
| Coupler C-7 | 0.046 g/m$^2$ |

| 5th Layer: Third Red-Sensitive Emulsion Layer | |
|---|---|
| Gelatin layer containing: | |
| silver iodobromide emulsion (silver iodide: 10 mol %; average grain size: 2.0 μm) | 1.6 g/m$^2$ (calculated as silver) |
| Sensitizing Dye I | $5.5 \times 10^{-5}$ mol per mol of silver |
| Sensitizing Dye II | $1.6 \times 10^{-5}$ mol per mol of silver |
| Sensitizing Dye III | $2.2 \times 10^{-5}$ mol per mol of silver |
| Sensitizing Dye IV | $1.6 \times 10^{-5}$ mol per mol of silver |
| Coupler C-5 | 0.030 g/m$^2$ |
| Coupler C-6 | 0.004 g/m$^2$ |

-continued

| 5th Layer: Third Red-Sensitive Emulsion Layer | |
|---|---|
| Gelatin layer containing: | |
| Coupler C-7 | 0.16 g/m$^2$ |
| FR Compound (II-1) | 0.010 g/m$^2$ |

| 6th Layer: Interlayer |
|---|
| Gelatin layer |

| 7th Layer: First Green-Sensitive Emulsion Layer | |
|---|---|
| Gelatin layer containing: | |
| silver iodobromide emulsion (silver iodide: 5 mol %; average grain size: 0.5 μm) | 0.55 g/m$^2$ (calculated as silver) |
| Sensitizing Dye V | $3.8 \times 10^{-4}$ mol per mol of silver |
| Sensitizing Dye VI | $3.0 \times 10^{-5}$ mol per mol of silver |
| Sensitizing Dye VII | $1.2 \times 10^{-4}$ mol per mol of silver |
| Coupler C-8 | 0.29 g/m$^2$ |
| Coupler C-9 | 0.040 g/m$^2$ |
| Coupler C-10 | 0.055 g/m$^2$ |
| Coupler C-11 | 0.058 g/m$^2$ |

| 8th Layer: Second Green-Sensitive Emulsion Layer | |
|---|---|
| Gelatin layer containing: | |
| silver iodobromide emulsion (silver iodide: 6 mol %; average grain size: 1.5 μm) | 1.5 g/m$^2$ (calculated as silver) |
| Sensitizing Dye V | $2.7 \times 10^{-4}$ mol per mol of silver |
| Sensitizing Dye VI | $2.1 \times 10^{-5}$ mol per mol of silver |
| Sensitizing Dye VII | $8.5 \times 10^{-5}$ mol per mol of silver |
| Coupler C-8 | 0.25 g/m$^2$ |
| Coupler C-9 | 0.013 g/m$^2$ |
| Coupler C-10 | 0.011 g/m$^2$ |

| 9th Layer: Third Green-Sensitive Emulsion Layer | |
|---|---|
| Gelatin layer containing: | |
| silver iodobromide emulsion (silver iodide: 10 mol %; average grain size: 2.2 μm) | 1.5 g/m$^2$ |
| Sensitizing Dye | $3.0 \times 10^{-4}$ mol per mol of silver |
| Sensitizing Dye VI | $2.4 \times 10^{-5}$ mol per mol of silver |
| Sensitizing Dye VII | $9.5 \times 10^{-5}$ mol per mol of silver |
| Coupler C-9 | 0.013 g/m$^2$ |
| Coupler C-11 | 0.002 g/m$^2$ |
| Coupler C-12 | 0.070 g/m$^2$ |
| FR Compound (III-2) | 0.001 g/m$^2$ |

| 10th Layer: Yellow Filter Layer | |
|---|---|
| Gelatin layer containing: | |
| yellow colloidal silver | 0.04 g/m$^2$ |
| 2,5-di-tert-pentadecyl-hydroquinone | 0.031 g/m$^2$ |

| 11th Layer: First Blue-Sensitive Emulsion Layer | |
|---|---|
| Gelatin layer containing: | |
| silver iodobromide emulsion layer (silver iodide: 6 mol %; average grain size: 0.4 μm) | 0.32 g/m$^2$ (calculated as silver) |
| Coupler C-13 | 0.68 g/m$^2$ |
| Coupler C-14 | 0.030 g/m$^2$ |

| 12th Layer: Second Blue-Sensitive Emulsion Layer | |
|---|---|
| Gelatin layer containing: | |
| silver iodobromide emulsion (silver iodide: 10 mol %; average grain size: 1.0 μm) | 0.40 g/m$^2$ (calculated as silver) |
| Sensitizing Dye VIII | 2.2 × 10$^{-4}$ mol per mol of silver |
| Coupler C-13 | 0.22 g/m$^2$ |

| 13th Layer: Third Blue-Sensitive Emulsion Layer | |
|---|---|
| Gelatin layer containing: | |
| Emulsion C | 0.40 g/m$^2$ (calculated as silver) |
| Sensitizing Dye VIII | 2.3 × 10$^{-4}$ mol per mol of silver |

-continued

| 13th Layer: Third Blue-Sensitive Emulsion Layer | |
|---|---|
| Gelatin layer containing: | |
| Coupler C-13 | 0.19 g/m$^2$ |

| 14th Layer: First Protective Layer | |
|---|---|
| Gelatin layer containing: | |
| Ultraviolet Absorber C-1 | 0.14 g/m$^2$ |
| Ultraviolet Absorber C-2 | 0.22 g/m$^2$ |

| 15th Layer: Second Protective Layer | |
|---|---|
| Gelatin layer containing: | |
| polymethyl methacrylate particles (average grain diameter: 1.5μ) | 0.05 g/m$^2$ |
| silver iodobromide emulsion (silver iodide: 2 mol %; average grain size: 0.07 μm) | 0.30 g/m$^2$ (calculated as silver) |

In addition, Gelatin Hardening Agent C-15 and a surfactant were added to the composition for each layer.

The chemical structures of the compounds used in this example are shown below.

C-1

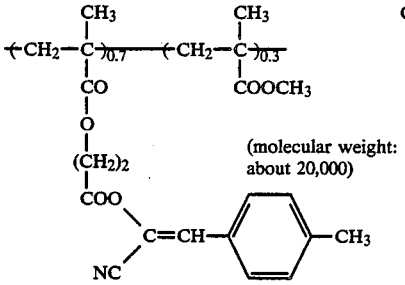

(molecular weight: about 20,000)

C-2

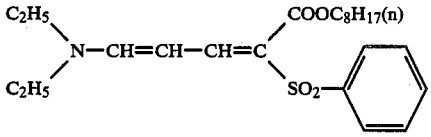

C-3

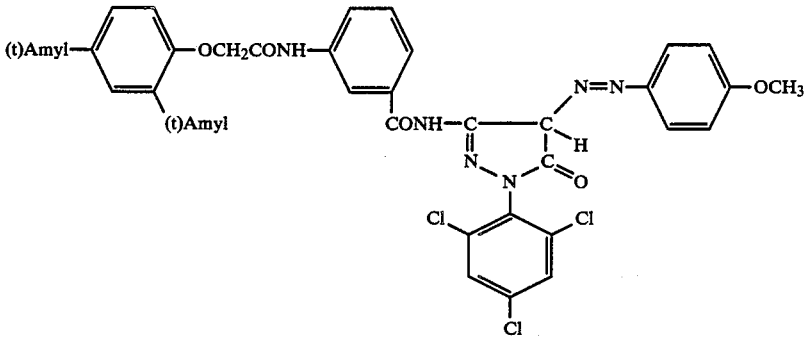

C-4

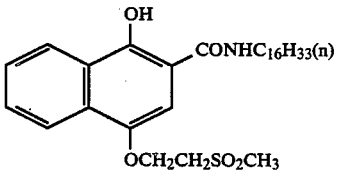

C-5

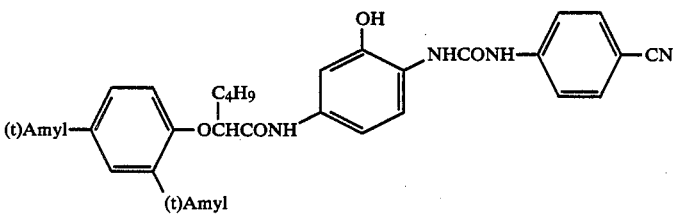

-continued
C-6
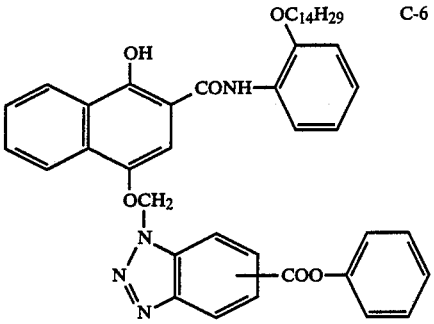
C-7
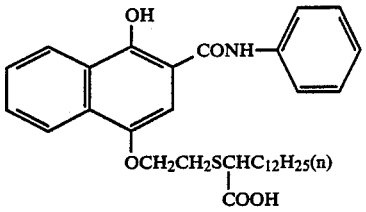
Polymer represented by
C-8
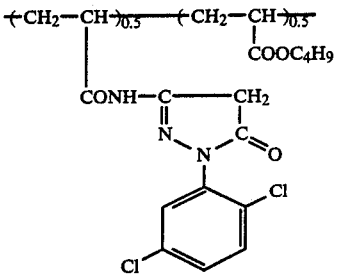
(molecular weight: about 25,000)
C-9
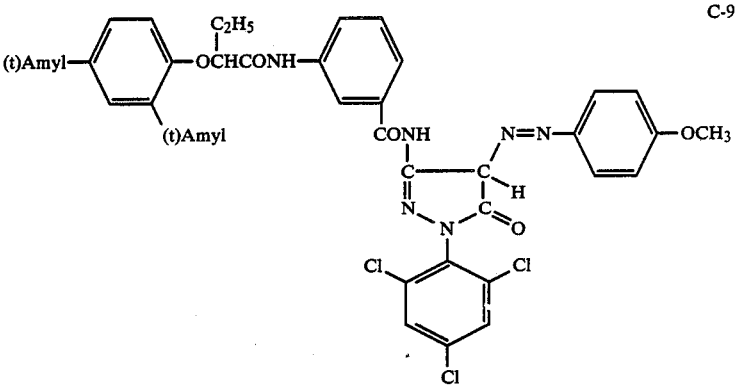
C-10
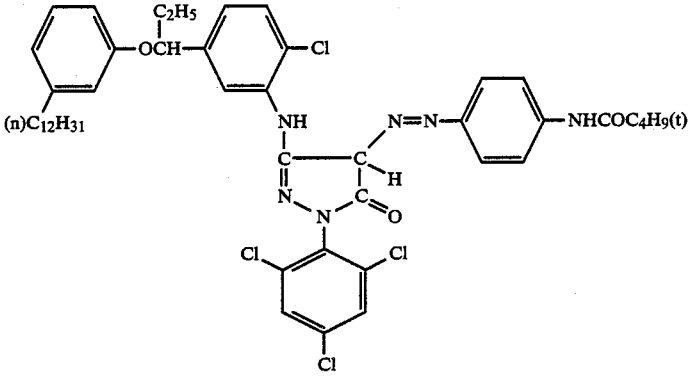
C-11
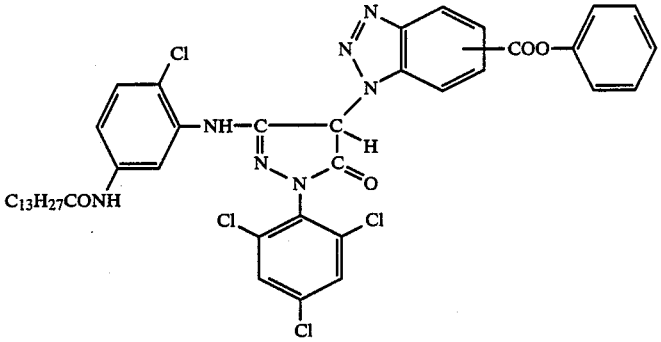

-continued
C-12
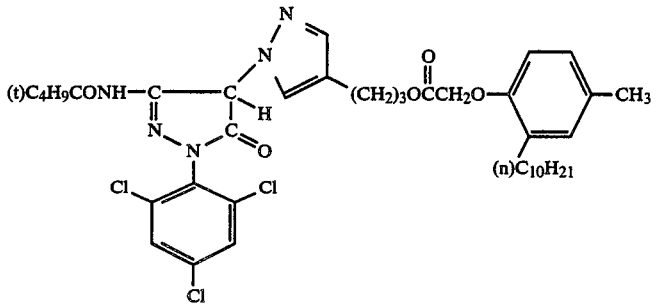
C-13
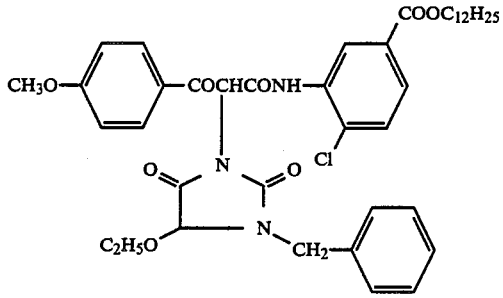
C-14
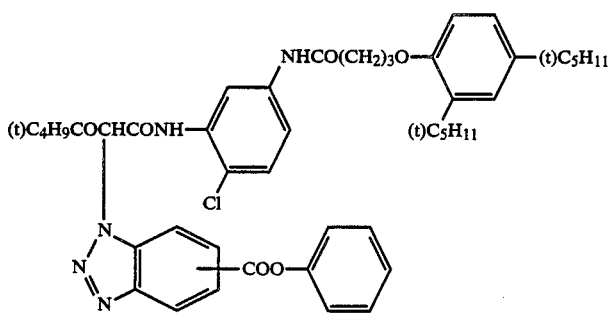
C-15
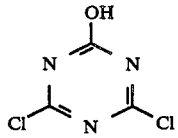
Sensitizing Dyes
I
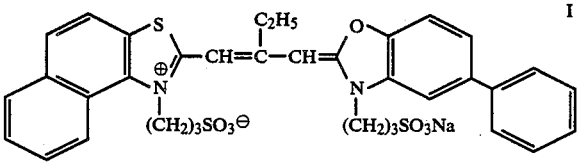
II
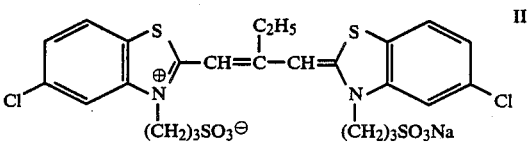
III
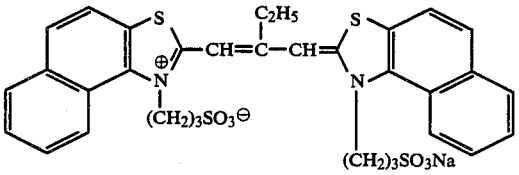
IV
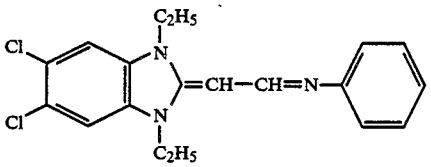

-continued

Sensitizing Dyes

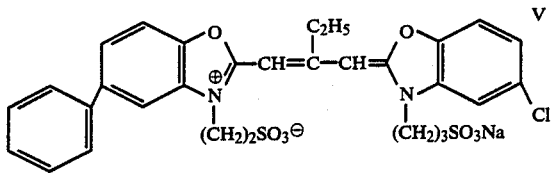

V

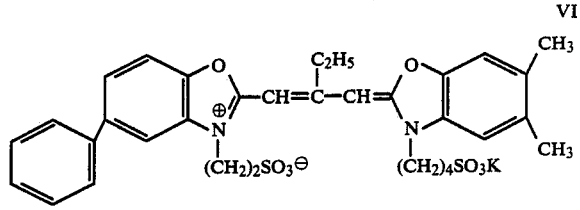

VI

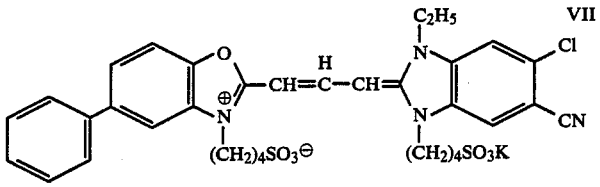

VII

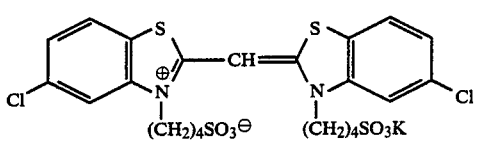

VIII

The above-prepared color negative film was exposed wedgewise and processed under the following conditions.

| Processing Step | Temperature (°C.) | Time (min) |
|---|---|---|
| Color development | 38 | 3 |
| Bleach | 38 | 1.5 |
| Fixing | 38 | 3 |
| Water-washing | 38 | 3 |
| Stabilization | 38 | 1 |

The photographic processing of the color negative film was performed at the first in processing solutions called herein "mother solutions", the volume of each mother solution being 2 liters and its composition being shown below and, thereafter, when 350 $cm^2$ of the color negative film was processed, fresh processing solutions called herein "replenishing solutions", the composition of each replenishing solution being shown below, were added to the mother solutions each in an amount of 50 ml. In this way, each time the photographic processing of 350 $cm^2$ of the color negative film was completed, the replenishing solutions were added and finally the color negative film was processed continuously over 1 $m^2$.

| Color Developer | Mother Solution | Replenishing Solution |
|---|---|---|
| Sodium nitrilotriacetate | 1.0 g | 1.1 g |
| Sodium sulfite | 4.0 g | 4.4 g |
| Sodium carbonate | 30.0 g | 32.0 g |
| Potassium bromide | 1.4 g | 0.7 g |
| Hydroxyamine sulfate | 2.4 g | 2.6 g |
| 4-(N—ethyl-N—β-hydroxyethyl-amino)-2-methylaniline sulfate | 4.5 g | 5.0 g |
| Water to make | 1 liter | 1 liter |

| Bleaching Solution | Mother Solution | Replenishing Solution |
|---|---|---|
| Ammonium bromide | 160.0 g | 176 g |
| Ammonia water (28%) | 25.0 ml | 15 ml |
| Sodium iron ethylenediamine-tetraacetate | 130.0 g | 143 g |
| Glacial acetic acid | 14.0 ml | 14.0 ml |
| Water to make | 1 liter | 1 liter |

| Fixing Solution | Mother Solution | Replenishing Solution |
|---|---|---|
| Sodium tetrapolyphosphate | 2.0 g | 2.2 g |
| Sodium sulfite | 4.0 g | 4.4 g |
| Ammonium thiosulfate (70%) | 175.0 ml | 193.0 ml |
| Sodium hydrogensulfate | 4.6 g | 5.1 g |
| Water to make | 1 liter | 1 liter |

| Stabilizer | Mother Solution | Replenishing Solution |
|---|---|---|
| Formalin | 8.0 ml | 9.0 ml |
| Water to make | 1 liter | 1 liter |

The thus-processed film was measured for density, and the results are shown as relative sensitivities in Table 2.

TABLE 2

| Sample No. | FR Compound | Relative Sensitivity |
|---|---|---|
| 301 (Comparative Example) | none | 100 |
| 302 (Example of the Invention) | I-9 | 117 |
| 303 (Example of the Invention) | I-20 | 120 |
| 304 (Example of the Invention) | I-6 | 125 |

The relative sensitivity is the reciprocal of an exposure amount to provide a density of fog +0.2 and expressed with that of Sample 301 as 100.

It can be seen from Table 2 that the light-sensitive materials of the present invention, Samples 302 to 304, are of high sensitivity. Moreover, examination of the silver halide grains for the materials under an optical microscope at a density of 1.5 as determined with a blue filter demonstrates that their graininess is equal irrespective of their high sensitivity.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a support having provided thereon at least one photographic layer including at least one silver halide emulsion layer, wherein at least one silver halide emulsion layer contains silver halide grains whose average value of the diameter corresponding to the projected area of a group of silver halide grains that take 40% of the total projected area of whole silver halide grains present in said silver halide emulsion layer is at least 1.5 μm, and at least one photographic layer contains at least one compound capable of imagewise releasing a fogging agent or a precursor thereof or a development accelerator or a precursor thereof corresponding to a quantity of developed silver upon development, wherein said compound is present in an amount of $10^{-8}$ to 0.5 mole per mole of said silver halide grains.

2. A silver halide photographic light-sensitive material as claimed in claim 1, wherein said silver halide emulsion layer contains both said silver halide grains and said compound.

3. A silver halide photographic light-sensitive material as claimed in claim 1, wherein at least two silver halide emulsion layers are provided on said support, said silver halide emulsion layers being sensitive to the same color but having different sensitivity from each other, and the silver halide emulsion layer other than the lowest sensitivity emulsion layer containing both silver halide grains whose average value of the diameter corresponding to the projected area of a group of silver halide grains that take 40% of the total projected area of whole silver halide grains present in said silver halide emulsion layer is at least 1.5 μm and at least one compound capable of imagewise releasing a fogging agent or a precursor thereof or a development accelerator or a precursor thereof corresponding to a quantity of developed silver upon development.

4. A silver halide photographic light-sensitive material as claimed in claim 1, wherein at least three silver halide emulsion layers are provided on said support, said silver halide emulsion layers being sensitive to the same color but having different sensitivity from each another, and the silver halide emulsion layer other than the lowest sensitivity emulsion layer containing both silver halide grains whose average value of the diameter corresponding to the projected area of a group of silver halide grains that take 40% of the total projected area of whole silver halide grains present in said silver halide emulsion layer is at least 1.5 μm and at least one compound capable of imagewise releasing a fogging agent or a precursor or a development accelerator or a precursor thereof corresponding to a quantity of developed silver upon development.

5. A silver halide photographic light-sensitive material as claimed in claims 1, 2, 3, or 4, wherein said silver halide grains are at least 1.7 μm in the average value of diameter.

6. A silver halide photographic light-sensitive material as claimed in claims 1, 2, 3, or 4, wherein said silver halide grains are at least 1.8 μm in the average value of diameter.

7. A silver halide photographic light-sensitive material as claimed in claims 1, 2, 3, or 4, wherein said silver halide grains are at least 2.0 μm in the average value of diameter.

8. A silver halide photographic light-sensitive material as claimed in claims 1, 2, 3, or 4, wherein said silver halide grains are those whose average value of the diameter corresponding to the projected area of a group of silver halide grains that take 40% or more of the total projected area of whole silver halide grains present in said silver halide emulsion layer is at least 1.5 μm.

9. A silver halide photographic light-sensitive material as claimed in claims 1, 2, 3, or 4, wherein said silver halide grains are those whose average value of the diameter corresponding to the projected area of a group of silver halide grains that take 50% or more of the total projected area of whole silver halide grains present in said silver halide emulsion layer is at least 1.5 μm.

10. A silver halide photographic light-sensitive material as claimed in claims 1, 2, 3, or 4, wherein said silver halide grains are those whose average value of the diameter corresponding to the projected area of a group of silver halide grains that take 70% or more of the total projected area of whole silver halide grains present in said silver halide emulsion layer is at least 1.5 μm.

11. A silver halide photographic light-sensitive material as claimed in claims 1, 2, 3, or 4, wherein said compound is present in an amount of $5\times10^{-7}$ to $10^{-2}$ mole per mole of said silver halide grains.

12. A silver halide photographic light-sensitive material as claimed in claims 1, 2, 3, or 4, wherein said compound is (i) a coupler capable of realeasing a fogging agent, a development accelerator or precursors thereof upon coupling with an oxidation product of an aromatic primary amine developing agent;

(ii) a coupler capable of forming a diffusible coupling product which functions as a fogging agent, a development accelerator or precursors thereof upon coupling with an oxidation product of an aromatic primary amine developing agent; or (iii) a redox compound capable of releasing a fogging agent, a development accelerator or precursors thereof upon oxidation reduction reaction with an oxidation product of an aromatic primary amine developing agent or the subsequent reaction; each is represented by the following formulae (1), (2) and (3), respectively:

$$\text{Cp—(TIME)}_n\text{—FA} \quad (1)$$

$$\text{BALL—Cp—(TIME)}_n\text{—FA} \quad (2)$$

$$\text{RED—(TIME)}_n\text{—FA} \quad (3)$$

wherein Cp represents a coupler residue capable of coupling with an oxidation product of an aromatic primary amine developing agent; BALL represents a non-diffusible group which is eliminated from Cp upon the coupling reaction with an oxidation product of an aromatic primary amine developing agent, RED represents a residue of a compound capable of undergoing oxidation reduction reaction with an oxidation product of an aromatic primary amine developing agent; TIME represents a timing group releasable from Cp or RED upon coupling reaction or oxidation reduction reaction to release FA; n represents 0 or 1; FA represents a group releasable from Cp or RED upon coupling when n is 0, or a group releasable from TIME when n is 1.

* * * * *